US009090374B2

(12) United States Patent
Oshino

(10) Patent No.: US 9,090,374 B2
(45) Date of Patent: Jul. 28, 2015

(54) BOTTLE

(71) Applicant: YOSHINO KOGYOSHO CO., LTD., Tokyo (JP)

(72) Inventor: Tadayoshi Oshino, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 13/935,153

(22) Filed: Jul. 3, 2013

(65) Prior Publication Data

US 2013/0292356 A1 Nov. 7, 2013

Related U.S. Application Data

(62) Division of application No. 13/055,346, filed as application No. PCT/JP2009/064204 on Aug. 11, 2009, now Pat. No. 8,505,758.

(30) Foreign Application Priority Data

| | | |
|---|---|---|
| Aug. 12, 2008 | (JP) | 2008-208191 |
| Nov. 28, 2008 | (JP) | 2008-305227 |
| Dec. 26, 2008 | (JP) | 2008-332491 |

(51) Int. Cl.

| | |
|---|---|
| ***B65D 1/02*** | (2006.01) |
| ***B65D 79/00*** | (2006.01) |
| *B65D 1/44* | (2006.01) |

(52) U.S. Cl.

CPC ..... *B65D 1/0223* (2013.01); *B65D 1/0292* (2013.01); *B65D 79/005* (2013.01); *B65D 1/02* (2013.01); *B65D 1/44* (2013.01); *B65D 2501/0036* (2013.01)

(58) Field of Classification Search

CPC ..... B65D 1/0223; B65D 1/02; B65D 79/005; B65D 2501/0036; B65D 1/44

USPC ..... 220/675, 673, 670; 215/383, 382, 381

See application file for complete search history.

(56) References Cited

U.S. PATENT DOCUMENTS

| | | | |
|---|---|---|---|
| 3,301,293 | A | 1/1967 | Santelli |
| 4,790,361 | A | 12/1988 | Jones et al. |

(Continued)

FOREIGN PATENT DOCUMENTS

| | | | |
|---|---|---|---|
| DE | 3123902 | A1 | 6/1982 |
| FR | 1199635 | A | 12/1959 |

(Continued)

OTHER PUBLICATIONS

International Search Report dated Nov. 2, 2009 in International Patent Application No. PCT/JP2009/064204 (with translation).

(Continued)

*Primary Examiner* — Stephen Castellano
(74) *Attorney, Agent, or Firm* — Oliff PLC

(57) ABSTRACT

Disclosed is a bottomed tubular bottle including an annular groove which is formed so as to be circumferentially and radially recessed inward along the outer peripheral surface of a body of the bottle with a bottle axis as a center and which contracts and deforms the body in the axial direction of the bottle when the internal pressure is reduced. The annular groove is recessed and formed by a first wall surface arranged on a mouth side of the bottle and a second wall surface arranged on a bottom side of the bottle. The body is formed so that the outer diameter on the bottom side is larger than the outer diameter on the mouth side with the annular groove interposed therebetween.

8 Claims, 12 Drawing Sheets

(56) References Cited

U.S. PATENT DOCUMENTS

| | | | | |
|---|---|---|---|---|
| 5,201,438 | A * | 4/1993 | Norwood | 220/666 |
| 5,584,413 | A | 12/1996 | Jung | |
| 7,051,890 | B2 | 5/2006 | Onoda et al. | |
| 7,077,279 | B2 | 7/2006 | Melrose | |
| 7,296,701 | B2 | 11/2007 | Ozawa et al. | |
| 7,374,055 | B2 | 5/2008 | Hatcher et al. | |
| 2004/0200799 | A1 | 10/2004 | Yourist et al. | |
| 2006/0243698 | A1 | 11/2006 | Melrose | |
| 2006/0289379 | A1 | 12/2006 | Ozawa et al. | |
| 2007/0199916 | A1 | 8/2007 | Denner et al. | |

FOREIGN PATENT DOCUMENTS

| | | | |
|---|---|---|---|
| GB | 2 025 889 | A | 1/1980 |
| JP | A-07-172424 | | 7/1995 |
| JP | A-2003-285814 | | 10/2003 |
| JP | A-2004-507405 | | 3/2004 |
| JP | A-2004-262500 | | 9/2004 |
| JP | A-2005-280755 | | 10/2005 |
| JP | A-2005-313975 | | 11/2005 |
| WO | WO 93/09031 | A1 | 5/1993 |
| WO | WO 02/47988 | A1 | 6/2002 |
| WO | WO 03/080452 | A1 | 10/2003 |
| WO | WO 2004/076298 | A1 | 9/2004 |

OTHER PUBLICATIONS

European Search Report mailed Oct. 19, 2012 in EP Application No. 12182982.4.

Dec. 21, 2012 Office Action issued in Japanese Patent Application No. 2008-305227 (with translation).

European Search Report dated Feb. 15, 2012 issued in European Patent Application No. 09806726.7.

May 28, 2013 Office Action issued in Japanese Patent Application No. 2008-305227 (with translation).

May 17, 2013 Search Report issued in European Patent Application No. 12182982.4.

Dec. 31, 2012 Office Action issued in U.S. Appl. No. 13/055,346.

* cited by examiner

A-A CROSS SECTION

BOTTLE

This is a Divisional of U.S. application Ser. No. 13/055,346 filed Jan. 21, 2011, which is a National Stage of International Application No. PCT/JP2009/064204 filed Aug. 11, 2009 now U.S. Pat. No. 8,505,758, which claims priority to Japanese Patent Application No. 2008-332491 filed on Dec. 26, 2008, Japanese Patent Application No. 2008-305227 filed on Nov. 28, 2008, and Japanese Patent Application No. 2008-208191 filed on Aug. 12, 2008, the prior application, including the specifications, drawings and abstracts are incorporated herein by reference in their entirety.

TECHNICAL FIELD

The present invention relates to a bottle, and particularly, to a bottle formed from synthetic resin. That is, the present invention relates to a compressively deformable bottle including a body and a bottom connected to the body via a heel, which are integrally molded, and absorbing the deformation accompanying a reduction in internal pressure by compressively deforming a portion of the bottle itself.

BACKGROUND ART

Since bottles made of synthetic resin which are represented by PET bottles are inexpensive in terms of costs, in addition to being lightweight and easy to handle, and assuming an appearance which is in no way inferior to glass containers while ensuring transparency, the bottles are mainly used as beverage containers.

Meanwhile, this kind of bottle has the disadvantage that because the thickness of the body is thin, when the inside of the bottle is brought into a pressure-reduced state, the body is deformed in irregular shapes, such as an elliptical or a triangular shape. In a case where the body has been deformed in this way, there is a problem in that not only is the aesthetic appearance impaired, but the operability is poor. Particularly in a case where the bottle is made lightweight by reducing its thickness, this problem becomes more conspicuous.

Thus, in order to suppress irregular deformation of the body caused when the internal pressure of the container drops (pressure is reduced), a bottle in which the body is provided with a pressure-reduction absorption panel is developed. However, since this type of bottle is inevitably restricted by the pressure-reduction absorption panel at the time of design, freedom of design is not possible, and problems are left unsolved in terms of design performance.

Apart from this, an unpanelled bottle which can suppress irregular deformation of a body at the time of pressure reduction without providing the body with a pressure-reduction absorption panel has recently been provided (see Patent Document 1 and Patent Document 2).

This bottle is a bottle in which an annular groove is formed in the outer peripheral surface of the body, and the body is capable of being contracted and deformed in the axial direction (longitudinal direction) with the annular groove as a center. That is, this bottle is designed so that a pressure change at the time of pressure reduction can be absorbed by contracting and deforming the body in the axial direction.

Additionally, as the compressively deformable bottle, for example, there is a heat-filled bottle (for example, refer to Patent Document 3) including a mouth, a cylindrical neck tube connected via a neck ring provided in the mouth, a shoulder which is enlarged in diameter integrally from the neck tube, a body connected to the shoulder, and a bottom connected to the body via a heel, which are integrally molded.

Here, an annular recess which splits the body into an upper portion and a lower portion is formed by recessing a portion of the body radially inward along the circumference of an axis, and the deformation accompanying a pressure reduction effect after cooling is absorbed by making an upper surface of the annular recess connected to the upper portion foldable toward a lower surface of the annular recess connected to the lower portion.

RELATED ART DOCUMENT

Patent Document

Patent Document 1: Japanese Unexamined Patent Application, First Publication No. 2005-280755

Patent Document 2: Japanese Unexamined Patent Application, First Publication No. 2004-262500

Patent Document 3: Published Japanese Translation No. 2004-507405 of the PCT International Publication

SUMMARY OF THE INVENTION

Problem to be Solved by the Invention

However, irregular deformation may be caused such as bending of the neck when the mouth side of the bottle may be bent depending on the degree of contracted deformation when the inside of the bottle is brought into a pressure-reduced state, and appearance degradation may result.

Otherwise, in a case where the inside of the bottle is actually brought into a pressure-reduced state, the bottle not only tends to be contracted and deformed in the axial direction, but also tends to be contracted and deformed more than a little even in the radial direction. That is, the pressure which will contract the bottle in the axial direction and the pressure which will contract the bottle in the radial direction will act on the bottle simultaneously. In these pressures, the pressure which will contract the bottle in the axial direction can be absorbed as the bottle is contracted and deformed with the annular groove as a center, the pressure which will contract the bottle in the radial direction may not be able to be absorbed by the portion of the annular groove. Therefore, folded wrinkles may be created in the annular groove.

If these folded wrinkles are created, the folded wrinkles may be plastically deformed, and appearance degradation or a decrease in the restoring force of the bottle (such as at the time of cap opening) may occur.

Additionally, even in the heat-filled bottle as disclosed in Patent Document 3, actually, the upper surface of the annular recess is not folded equally toward the lower surface thereof, but the upper portion of the body may be deformed in the state of being inclined with respect to the axis. Since such a deformation is recognized as contributing to poor appearance, there is room for further improvement.

The invention has been made in consideration of such a situation, and the object thereof is to provide a bottle which can be contracted and deformed in the axial direction, thereby effectively absorbing a pressure change generated at the time of pressure reduction and which can suppress irregular deformation, such as bending of the neck at the time of contraction and deformation.

Another object of the invention is to provide a bottle which can be contracted and deformed in the axial direction while suppressing the creation of folded wrinkles at the time of pressure reduction and which can reliably absorb a pressure change caused at the time of pressure reduction.

Means for solving the Problem

In order to achieve the above object, the invention provides the following apparatus.

A bottle according to an aspect of the present invention is a bottomed tubular bottle including an annular groove which is formed so as to be circumferentially and radially recessed inward along the outer peripheral surface of a body of the bottle with the bottle axis as a center and which contracts and deforms the body in the axial direction of the bottle when the internal pressure is reduced. The annular groove is recessed and formed by a first wall surface arranged on a mouth side of the bottle and a second wall surface arranged on the bottom side of the bottle. The body is formed so that the outer diameter on the bottom side is larger than the outer diameter on the mouth side with the annular groove interposed therebetween.

In the bottle according to the above aspect of the present invention, since the annular groove recessed and formed by the first wall surface and second wall surface is circumferentially formed in the outer peripheral surface of the body, the body is contracted and deformed in the axial direction with the annular groove as a center when the internal pressure is reduced. Thereby, a pressure change at the time of pressure reduction can be absorbed by the axial contraction of the bottle.

Meanwhile, the body is formed so as to have different outer diameters with the annular groove therebetween. That is, the outer diameter on the bottom side is made to be larger than the outer diameter on the mouth side. Therefore, when the body has been contracted in the axial direction to such a degree that the annular groove is crushed by pressure reduction, the body located on the mouth side with the annular groove as a boundary is brought into the state of riding on and being supported by the body on the bottom side, and consequently the posture of the bottle is stabilized. Particularly, since the body on the mouth side is not partially supported, but rather is supported over its entire circumference by the body on the bottom side, the posture of the bottle is remarkably stable.

Accordingly, in the contraction deformation in the axial direction, irregular deformation, such as bending of the neck when the mouth side of the body is bent, hardly occurs. Hence, the occurrence of appearance degradation can be suppressed.

Additionally, in the bottle of the above aspect of the present invention, the first wall surface may be formed in the shape of a plane directed toward the bottle axis from the outer peripheral surface of the body, and the second wall surface may be formed in the shape of a curved surface directed toward the outer peripheral surface of the body from the bottle axis.

In a bottle according to another aspect of the present invention, the first wall surface, which is located on the mouth side, of the two wall surfaces which constitutes the annular groove is formed in the shape of a plane, and the second wall surface located on the bottom side is formed in the shape of a curved surface. Particularly, since the second wall surface is formed in the shape of a curved surface which is curved toward the outer peripheral surface of the body from the bottle axis (in the shape of a curved surface which is convex toward the inside of the bottle), the orientation of the second wall surface changes gradually so as to become parallel to the bottle axis as it approaches to the bottle axis which is connected to the first wall surface. Accordingly, when the internal pressure is reduced, the body on the mouth side can be easily pulled downward, and axial contraction deformation can be made to occur easily.

Typically, in a case where contraction deformation is made in the axial direction, it is natural that the body on the mouth side moves downward. In this regard, since the body on the mouth side is easily pulled downward by the second wall surface, contraction deformation can be made to occur easily in a nearly natural form. Accordingly, a pressure change at the time of pressure reduction can be absorbed more effectively.

Additionally, in the bottle of the above aspect of the present invention, the first wall surface may be a horizontal surface orthogonal to the bottle axis.

In the bottle related to the aspect of the present invention, since the first wall surface located on the mouth side is a horizontal surface orthogonal to the bottle axis, a surface parallel to the bottle axis does not exist. Therefore, the body on the mouth side can be more positively pulled downward by the second wall surface. Accordingly, contraction deformation can be promoted more positively, and a pressure change at the time of pressure reduction can be absorbed more effectively.

Additionally, since the first wall surface is the horizontal surface, when contraction deformation is made to such a degree that the annular groove is crushed, the body on the mouth side easily rides on the body on the bottom side in a more stable state, and the posture of the bottle is stabilized further. Accordingly, irregular deformation, such as bending of the neck, can be suppressed more effectively.

In order to achieve the above object, the invention further provides the following apparatus. A bottle according to another aspect of the present invention is a bottomed tubular bottle including an annular groove which is formed so as to be circumferentially and radially recessed inward along the outer peripheral surface of a body with the bottle axis as a center and which contracts and deforms the body in the axial direction of the bottle when the internal pressure is reduced. The annular groove is formed in the shape of the letter V by two facing wall surfaces, and a protrusion is formed on at least one wall surface of the wall surfaces.

In the bottle according to the aspect of the present invention, since the annular groove is circumferentially recessed and formed in the body, the body is contracted and deformed in the axial direction with the annular groove as a center when the internal pressure is reduced. Thereby, a pressure change at the time of pressure reduction can be absorbed by the axial contraction of the bottle. Moreover, since the annular groove is formed in the shape of the letter V by the two wall surfaces, the body is easily contracted and deformed in the axial direction with the annular groove therebetween. Hence, the above pressure change can be immediately absorbed with an immediate reaction.

On the other hand, since the bottle receives the pressure which will contract the bottle in the radial direction independently from the pressure which will contract the bottle in the axial direction at the time of pressure reduction, the portion of the annular groove is pulled radially inward. However, the protrusion is formed on at least one wall surface of the two wall surfaces which constitute the annular groove. Therefore, it is considered that the state, where elastic deformation with the protrusion as a base point easily occurs, is locally formed. Accordingly, it is considered that the pressure which will contract the bottle in the radial direction can be absorbed by the elastic deformation.

Thereby, an internal pressure change caused at the time of pressure reduction can be reliably absorbed. Accordingly, it is possible to suppress creation of folded wrinkles in the annular groove. Hence, the probability that plastic defamation in which a portion of the surface of the bottle bends may be caused at the time of pressure reduction can be suppressed.

Additionally, in the bottle according to the above aspect of the present invention, a plurality of the protrusions may be formed at regular intervals in the circumferential direction.

In the bottle according to the above aspect of the present invention, since the plurality of protrusions is formed on at least one wall surface of the two wall surfaces which constitute the annular groove, the protrusions which are formed at regular intervals in this circumferential direction respond to a pressure change equally in a well-balanced manner. Accordingly, it is possible to further reduce a probability that folded wrinkles may be created in the annular groove.

Additionally, in the bottle according to the above aspect of the present invention, the protrusion may be formed so as to enter closer to the annular groove side than the outer peripheral surface of the body.

In the bottle according to the above aspect of the present invention, the protrusion is formed in a state where the protrusion is completely stored in the wall surface. Therefore, the protrusion is designed so that a portion thereof is not exposed to the outer peripheral surface side of the body. Accordingly, the protrusion hardly comes into direct contact with other bottles or the like. Therefore, the protrusion can be prevented from being accidentally recessed in advance. Additionally, since the protrusion does not come into contact with a connecting corner which is a boundary line between the outer surface (outer peripheral surface of the body) of the bottle and the wall surface, creation of folded wrinkles can be prevented from being induced at the connecting corner in advance.

Additionally, in the bottle according to the above aspect of the present invention, a recess which accommodates the protrusion may be formed at a position which faces the protrusion on at least the other wall surface of the two wall surfaces when both the wall surfaces approach each other in the axial direction of the bottle axis.

In the bottle according to the above aspect of the present invention, since the recess which accommodates the protrusion is formed at a position which faces the protrusion, even if the body is contracted and deformed to such a degree that the annular groove is crushed, the protrusion can be prevented from interfering with the wall surface.

When the internal pressure is reduced, the body is contracted and deformed in the axial direction with the annular groove as a center, thereby absorbing a pressure change within the bottle. However, in a case where this pressure change is comparatively large, the body is contracted and deformed to such a degree that the annular groove is crushed. In this case, the protrusion may interfere with the wall surface and may hinder contraction deformation of the body.

However, since the recess in which the protrusion is accommodated is formed as described above, the probability that the protrusion may interfere with the wall surface and hinder contraction deformation of the body can be eliminated.

Additionally, in the bottle according to the above aspect of the present invention, the recess may be formed so as to enter closer to the annular groove side than the outer peripheral surface of the body.

In the bottle according to the above aspect of the present invention, the recess is formed in a state where the recess is completely stored in the wall surface. Therefore, the recess is designed so that a portion thereof is not exposed to the outer peripheral surface side of the body. Accordingly, the recess hardly comes into direct contact with other bottles. Thereby, the local deformation which may be caused in a case where the recess comes into contact with other bottles or the like can be prevented in advance.

Additionally, in the bottle according to the above aspect of the present invention, the protrusion may have a ridgeline which extends toward the outer peripheral surface of the body while being orthogonal to the circumferential direction of the wall surface when the wall surface on which the protrusion is formed is seen in plane view.

In the bottle according to the above aspect of the present invention, the protrusion is formed in a shape having one ridgeline. Moreover, the ridgeline extends toward the outer peripheral surface of the body in a state where the ridgeline is orthogonal to the circumferential direction of the wall surface when this ridgeline is seen in plane view. That is, the ridgeline extends radially outward when the body is seen from the axial direction of the bottle axis. Therefore, the protrusion is in the state of being easily deformed with this ridgeline as a base point. Accordingly, it is considered that the elastic deformation with the protrusion as a base point occur more smoothly. Thereby, an internal pressure change caused at the time of pressure reduction is easily and more reliably absorbed.

In order to achieve the above object, the invention further provides the following apparatus. Another aspect of the present invention is a compressively deformable bottle constructed by integrally molding a body and a bottom connected to the body via a heel. The body includes a smaller diameter portion which is a lower portion of the body, a larger diameter portion which is an upper portion of the body which is made to have a larger diameter than the smaller diameter portion, a first annular recess formed by recessing a portion of the larger diameter portion radially inward along the circumference of an axis, and a second annular recess formed by recessing a portion of the smaller diameter portion radially inward along the circumference of the axis so as to come into contact with the larger diameter portion, wherein the maximum depth of the second annular recess from the larger diameter portion is larger than the maximum depth of the first annular recess from the larger diameter portion and equal to or smaller than the axial dimension between the first annular recess and the second annular recess.

The first annular recess includes a recess in which a maximum inner diameter portion thereof forms an annular flat surface, and this flat surface is connected to the upper portion and lower portion of the larger diameter portion split by the first annular recess. In this case, the upper portion and the maximum inner diameter portion may be connected together by an annular flat surface, which extends while inclining radially outward toward the upper portion, or horizontally extends radially outward toward the upper portion, or by an annular curved surface, which swells to the inside or outside of the recess. Additionally, the lower portion and the maximum inner diameter portion may also be connected together by an annular flat surface, which extends while inclining radially outward toward the lower portion or horizontally extends radially outward toward the lower portion, or by an annular curved surface, which swells to the inside or outside of the recess.

Additionally, the first annular recess may be constructed as an annular curved surface which connects together the upper portion and lower portion of the larger diameter portion, which are split by the first annular recess, and the inflection point thereof may be used as the maximum inner diameter portion. That is, annular recesses having various cross-sectional shapes can be employed as the first annular recess if the annular recesses have shapes which can exhibit high strength (high rigidity at which deformation hardly occurs) against buckling.

On the other hand, the maximum inner diameter portion of the second annular recess may be an annular curved surface or may be an annular flat surface as long as the annular upper surface connected to the larger diameter portion can be folded toward the annular lower portion connected to the smaller diameter portion.

Additionally, the upper surface of the second annular recess may be adapted such that deformation thereof hardly occurs when it is folded toward the lower surface thereof. For example, the upper surface may be constructed as an annular curved surface curving a part between the larger diameter portion and the maximum inner diameter portion toward the inside or outside of the recess; or may be constructed as a flat surface horizontally extending the part radially outward toward the larger diameter portion, or extending and inclining the part radially outward or the like. Additionally, in combination with this, a part of the larger diameter portion which comes into contact with the second annular recess may be constructed as a curved surface curving toward the inside or outside of the recess; or may be constructed as a flat surface horizontally extending radially outward toward the larger diameter portion, or extending and inclining radially outward or the like.

Additionally, the lower surface of the second annular recess may also be adapted such that deformation hardly occurs when the lower surface thereof is folded. For example, the lower surface may be an annular flat surface horizontally extending a part between the smaller diameter portion and the maximum inner diameter portion radially outward toward the smaller diameter portion or extending and inclining the part radially outward; or may be constructed as an annular curved surface curving the part toward the inside or outside of the recess. Additionally, in combination with this, a part of the smaller diameter portion which comes into contact with the lower surface of the second annular recess may be constructed as a curved surface curving toward the inside of the recess.

Moreover, the second annular recess may be formed in the smaller diameter portion so as to come into contact with the lower end of the larger diameter portion. In this case, the upper surface of the second annular recess may be connected to the larger diameter portion so that the outermost diameter thereof becomes equal to the outer diameter of the smaller diameter portion. However, the upper surface of the second annular recess may be adapted so that the outermost diameter thereof is longer than the outermost diameter of the smaller diameter portion or shorter than the outermost diameter of the smaller diameter portion.

That is, annular recesses having various cross-sectional shape can be adopted as the second annular recess if the annular recesses have shapes such that the annular upper surface which is connected to the larger diameter portion is easily folded toward the annular lower surface which is connected to the smaller diameter portion (such that deformation hardly occurs).

In addition, the maximum depth of the second annular recess from the larger diameter portion is set to be larger than the maximum depth of the first annular recess from the larger diameter portion and equal to or smaller than the axial dimension between the first annular recess, and the second annular recess. Thereby, the annular upper surface of the second annular recess is more easily folded toward the annular lower surface.

Additionally, in the present invention, the maximum depth of the first annular recess from the larger diameter portion may be set to be half or less of the maximum depth of the second annular recess from the larger diameter portion.

Additionally, in the present invention, the upper surface of the second annular recess which is connected to the larger diameter portion may be folded toward the lower surface of the second annular recess which is connected to the smaller diameter portion.

Effects of the Invention

According to the bottle related to the aspect of the present invention, a pressure change caused at the time of pressure reduction can be absorbed by axial contraction deformation. In addition to this, since the body on the mouth side is stably supported by the body on the bottom side even in a case where contraction deformation has occurred to such a degree that the annular groove is crushed, irregular deformation, such as bending of the neck, can be suppressed.

Moreover, according to the bottle related to the aspect of the present invention, the bottle can be contracted and deformed in the axial direction while suppressing the creation of folded wrinkles at the time of pressure reduction, and a pressure change caused at the time of pressure reduction can be absorbed reliably.

Moreover, in the aspect of the present invention, as the internal pressure of the bottle is reduced or an external force is applied to the bottle in the direction of the axis, the bottle can be easily compressed and deformed in the direction of the axis.

Furthermore, according to the aspect of the present invention, even after the upper surface of the second annular recess is folded toward the lower surface thereof, the folded state can be maintained. Since the folded state is not related to whether or not the bottle is in a pressure-reduced state, contents can also be filled in a state where the bottle is folded and compressed in advance.

Accordingly, in the bottle according to the aspect of the present invention, the body of the bottle is equally folded in the direction of the axis and the folded state is maintained even if the internal pressure of the bottle is reduced. Therefore, it is possible to provide to the market or the like a bottle which has an aesthetic outward appearance, and is beautiful.

In addition, it is considered that the reason why the folding in the second annular recess becomes easy is because the rigidity in the first annular recess formed above the second annular recess 2 is high, the first annular recess is not buckled, the larger diameter portion spreads radially outward, and thereby the second annular recess easily bends radially inward. On the other hand, it is considered that the reason why the folded state in the second annular recess is maintained is because the first annular recess with high rigidity prevents its restoration if the larger diameter portion spreads radially outward and the second annular recess is bent once.

For this reason, in the present invention, if the maximum depth of the first annular recess is set to be half or less of the maximum depth of the second annular recess from the larger diameter portion, the rigidity of the first annular recess is increased effectively. Thus, the folding in the second annular recess becomes still easier, and the folded state can be maintained more firmly.

BEST MODE FOR CARRYING OUT THE INVENTION

Hereinafter, a first embodiment of a bottle according to the present invention will be described with reference to FIGS. 1 to 3. In addition, in the present embodiment, description will be made taking a round bottle formed with a circular cross-section as an example.

Figure 1:
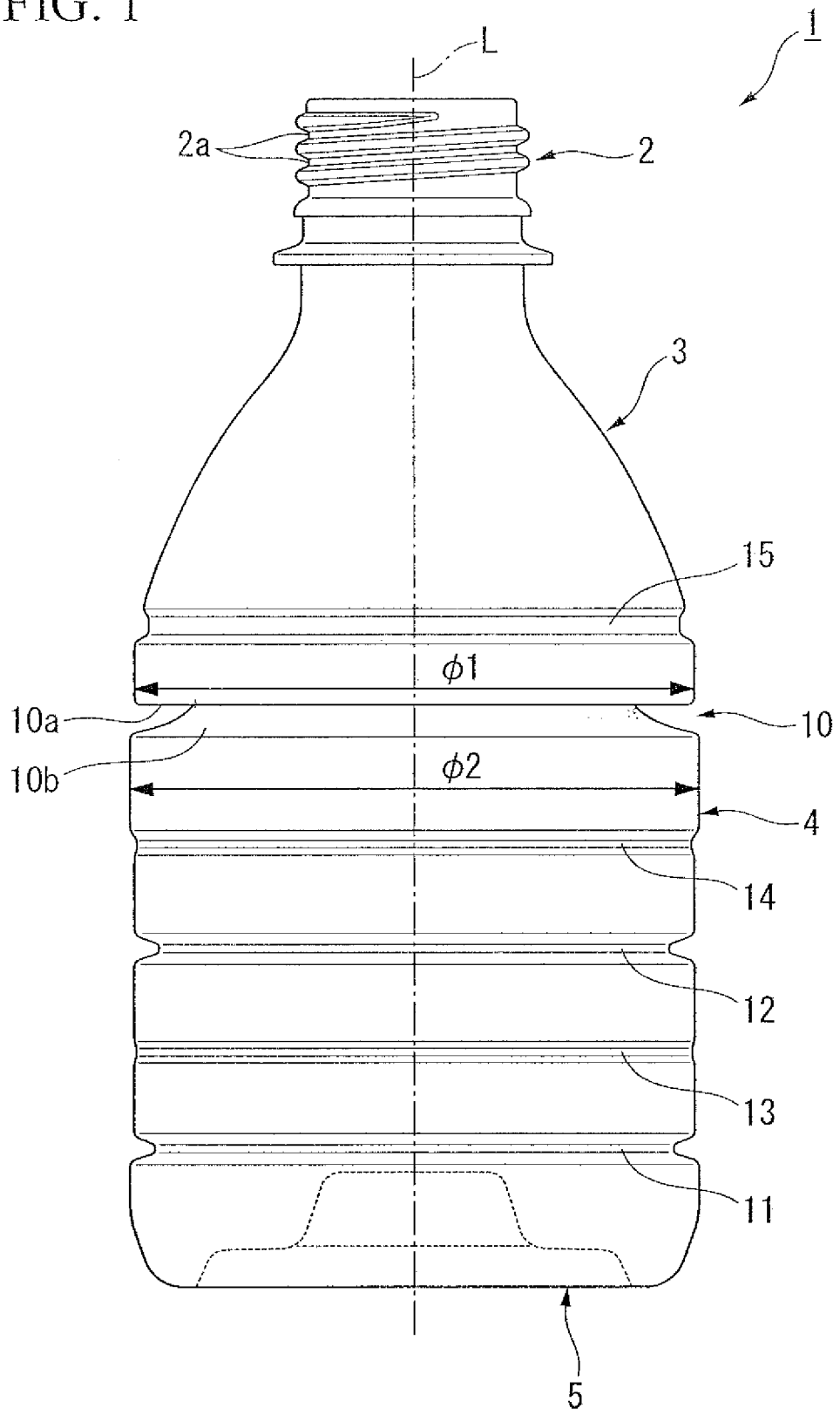
FIG. 1 is a front view showing a first embodiment of a bottle according to the present invention.

As shown in FIG. 1, the bottle 1 of the present embodiment is a bottomed tubular bottle 1 in which a mouth 2, a shoulder 3, a body 4, and a bottom 5 are integrally and continuously formed along a bottle axis L. Specifically, the bottle is integrally formed from synthetic resins, such as polyethylene terephthalate (PET), for example, by biaxially-drawn blow molding.

The body 4 is a portion which is connected to an upper portion of the bottom 5 and formed in a tubular shape with the bottle axis L as a center. The body 4 will be described below in detail. The shoulder 3 is a portion which is connected so that its diameter decreases gradually upward from an upper end of the body 4. The mouth 2 is a portion which is connected so as to extend upward from the upper end of the shoulder 3, and which becomes a spout when the contents (not shown) to be filled into the bottle 1 are poured out. In addition, the outer peripheral surface of the mouth 2 is formed with a threaded portion 2*a* on which a cap (not shown) is threadedly mounted.

Figure 2:
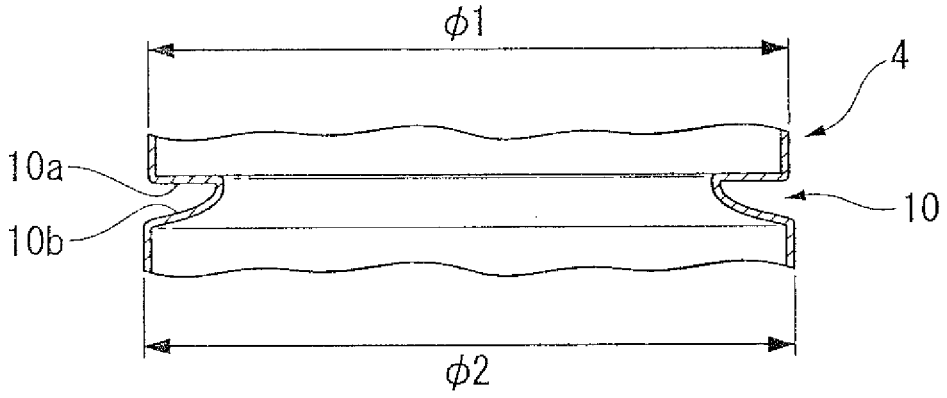
FIG. 2 is a cross-sectional view of the periphery of an annular groove of the bottle shown in FIG. 1.
Figure 3:
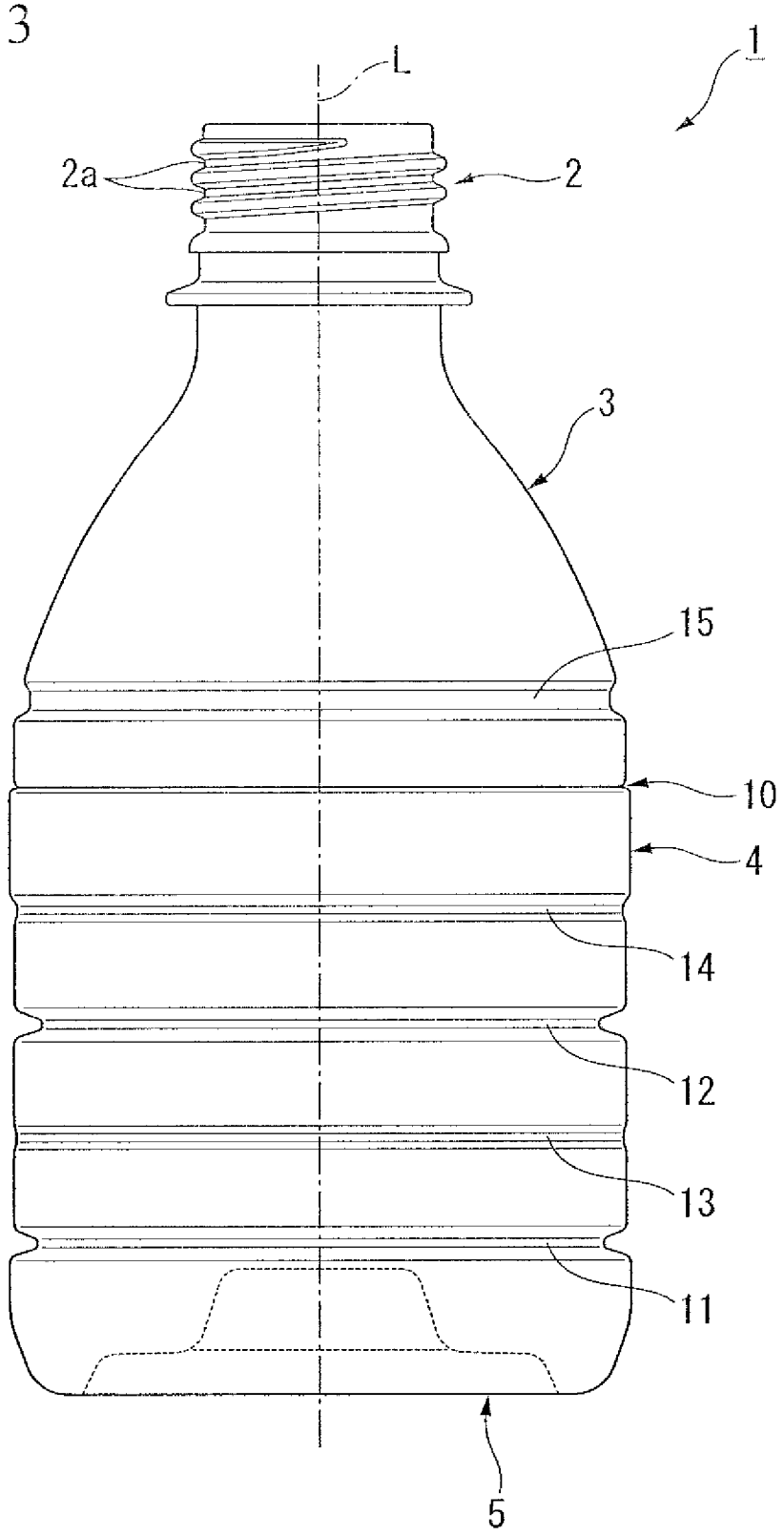
FIG. 3 is a view showing a state where a body has been contracted and deformed in the axial direction of a bottle axis to such a degree that an annular groove is crushed, from a state shown in FIG. 1.

As shown in FIGS. 1 and 2, the body 4 is formed with a circular cross-section with the bottle axis L as a center. The body 4 is formed with an annular groove 10 for contracting and deforming the body 4 along the axial direction of the bottle axis L when the internal pressure has been reduced, four annular ribs 11, 12, 13, and 14 which increase the rigidity of the bottle 1 and supplementarily absorbs a pressure change at the time of pressure reduction, and one annular reinforcing rib 15 which increases the rigidity of the bottle 1.

The annular groove 10 is a groove which is formed so as to be circumferentially and radially recessed inward along the outer peripheral surface of the body 4 with the bottle axis L as a center on the upper side of the body 4 near the shoulder 3.

Specifically, the annular groove 10 of the present embodiment is recessed and formed by a first wall surface 10*a* arranged on the mouth 2 side and a second wall surface 10*b* arranged on the bottom 5 side. The first wall surface 10*a* of the two wall surface 10*a* and 10*b* is a flat (planar) wall surface which extends radially inward from the outer peripheral surface of the body 4. In more detail, the first wall surface 10*a* is a horizontal surface which extends so as to be orthogonal to the bottle axis L.

On the other hand, the second wall surface 10*b* is a wall surface which connects the first wall surface 10*a* and the outer peripheral surface of the body 4 together, and is formed in the shape of a curved surface which is smoothly curved toward the outer peripheral surface of the body 4 from the bottle axis (in the shape of a curved surface which is convex toward the inside of the bottle). Particularly, the second wall surface 10*b* is adapted to gradually change in orientation so as to become parallel to the bottle axis L as it approaches the bottle axis which is connected to the first wall surface 10*a*.

Since the annular groove 10 is circumferentially recessed and formed in the body 4, the body 4 is adapted to be capable of being contracted and deformed in the axial direction of the bottle axis L with the annular groove 10 as a center when the internal pressure has been reduced. In this case, as shown in FIG. 3, the body is adapted to be capable of being contracted and deformed to such a degree that the annular groove 10 is crushed, i.e., to such a degree that the first wall surface 10*a* and second wall surface 10*b* approach to a position almost near abutment.

Meanwhile, as shown in FIGS. 1 and 2, the body 4 is formed so that an outer diameter $\phi$1 on the mouth 2 side and an outer diameter $\phi$2 on the bottom 5 side become different sizes with the annular groove 10 interposed therebetween. In detail, the body 4 is designed so that the outer diameter $\phi$2 on the bottom 5 side is larger than the outer diameter $\phi$1 on the mouth 2 side. Thereby, when the body is contracted and deformed to such a degree that the annular groove 10 is crushed, as shown in FIG. 3, the body 4 located on the mouth 2 side with the annular groove 10 as a boundary is brought into the state of riding on and being supported by the body 4 located on the bottom 5 side so that the posture of the bottle is stabilized. This point will be described below in detail.

The four annular ribs 11, 12, 13, and 14 are all grooves which are circumferentially and radially recessed inward and formed along the outer peripheral surface of the body 4, and mainly play a role of increasing the rigidity of the whole bottle 1, thereby preventing the body 4 from being irregularly deformed (for example, deformation in an elliptical cross-sectional shape or a triangular cross-sectional shape) in the radial direction at the time of pressure reduction or from being deformed due to the gripping force when the body 4 is gripped, the external force applied at the time of production and distribution, or the like.

Additionally, in addition to this main purpose, the annular ribs 11, 12, 13, and 14 also play a supplementary role of contracting and deforming the bottle 1 in the axial direction and absorbing the remaining pressure change in a case where a pressure change caused at the time of pressure reduction has not been absorbed enough by the annular groove 10. Therefore, the annular ribs 11, 12, 13, and 14 are recessed and formed so as be shallower than the annular groove 10.

Particularly, two annular ribs 11 and 12 of the four annular ribs 11, 12, 13, and 14 are formed so as to be deeper than two remaining annular ribs 13 and 14. That is, the two annular ribs 11 and 12 are ribs which have a slightly higher importance for promoting axial contraction deformation than for increasing rigidity. On the other hand, contrary to this, the two remaining annular ribs 13 and 14 are ribs which have a slightly higher importance for increasing rigidity than for increasing axial contraction deformation.

As such, two kinds of annular ribs 11, 12, 13, and 14 which have slightly different roles are arranged alternately from the bottom 5 side.

In addition, in the present embodiment, the annular rib 11 is first arranged on the bottom 5 side. Contrary to this, however, the annular rib 13 may be arranged first. Additionally, the annular ribs may not be arranged alternately, and the balance of an arrangement may be appropriately changed according to the size, shape, or the like of the bottle 1. Additionally, the annular ribs are lot limited to the four annular ribs, and the number of the annular ribs may be changed appropriately.

The annular reinforcing rib 15 is circumferentially and radially recessed inward and formed along the outer peripheral surface of the body 4 at a position nearer the shoulder 3 than the annular groove 10. The annular reinforcing rib 15 has a role of preventing the body 4 from being irregularly deformed in the radial direction at the time of pressure reduction or from being deformed due to the gripping force when the body 4 is gripped. Hence, the annular reinforcing rib 15 is recessed and formed so as to be shallower than the annular groove 10, and is designed so that the body 4 is not contracted and deformed in the axial direction substantially with the annular reinforcing rib 15 as a center.

Next, a case where the internal pressure of the bottle 1 constructed in this way has been reduced for the reasons of cooling or the like after heating and filling of the contents thereof will be described below.

In a case where the internal pressure has been reduced, the pressure which will contract the bottle in the axial direction of the bottle axis L mainly acts on the whole bottle 1. In this case, since the annular groove 10 is circumferentially recessed and formed in the body 4, the body 4 is contracted and deformed in the axial direction with the annular groove 10 as a center. Thereby, the above pressure change at the time of pressure reduction can be absorbed by the axial contraction of the bottle 1.

Meanwhile, the body 4 of the bottle 1 is designed so that the outer diameter $\phi 2$ on the bottom 5 side is larger than the outer diameter $\phi 1$ on the mouth 2 side. Therefore, as shown in FIG. 3, when the body 4 has been contracted in the axial direction to such a degree that the annular groove 10 is crushed by pressure reduction, the body 4 located on the mouth 2 side is brought into the state of riding on and being supported by the body 4 on the bottom 5 side, and consequently the posture of the bottle is stabilized. Particularly, since the body 4 on the mouth 2 side is not partially supported but supported over its entire circumference by the body 4 on the bottom 5 side, the posture of the bottle is remarkably stable.

Accordingly, even if the contraction deformation by the annular groove 10 occurs, irregular deformation, such as bending of the neck where the mouth 2 side of the body 4 bends, hardly occurs. Hence, occurrence of appearance degradation can be suppressed.

As described above, according to the bottle 1 of the present embodiment, by contracting and deforming the body 4 in the axial direction, not only the pressure change which has occurred at the time of pressure reduction can be absorbed but also occurrence of irregular deformation, such as bending of the neck in this contraction deformation, can be suppressed.

Moreover, in the bottle 11 of the present embodiment, the body 4 is provided with the four annular ribs 11, 12, 13, and 14 separately from the annular groove 10. Thus, the pressure change which could not be absorbed by the annular groove 10 can be absorbed by the contraction deformation with the four annular ribs 11, 12, 13, and 14 as centers. Moreover, since the whole rigidity is increased by the four annular ribs 11, 12, 13, and 14 and one annular reinforcing rib 15, irregular deformation of the body 4 hardly occur at the time of pressure reduction, and the radial rigidity, for example, when the bottle 1 is gripped, is also excellent.

In addition, since the bottle 1 is a bottle of an unpanelled type in which the body 4 is not provided with a general pressure-reduction absorption panel, the design thereof can be comparatively freely performed without being restricted by the pressure-reduction absorption panel. Hence, the degree of design freedom can be improved.

Additionally, the bottle 1 of the present embodiment can exhibit the following working effects in addition to the above-described working effects.

That is, the second wall surface 10*b* located on the bottom 5 side among the two wall surfaces which constitutes the annular groove 10 is formed in the shape of a curved surface which is curved toward the outer peripheral surface of the body 4 from the bottle axis, and gradually changes in orientation so as to become parallel to the bottle axis L as it approaches the bottle axis connected to the first wall surface 10*a*. Accordingly, when the internal pressure is reduced, the body 4 on the mouth 2 side can be easily pulled downward, and axial contraction deformation can be made to occur easily. Typically, in a case where contraction deformation is made in the axial direction, it is natural that the body 4 on the mouth 2 side moves downward. In this regard, since the body 4 on the mouth 2 side is easily pulled downward by the second wall surface 10*b*, contraction deformation can be made to occur easily in a nearly natural form. Accordingly, a pressure change at the time of pressure reduction can be absorbed more effectively.

Moreover, since the first wall surface 10*a* is a horizontal surface orthogonal to the bottle axis L, a surface parallel to the bottle axis L does not exist. Therefore, the body 4 on the mouth 2 side can be more positively pulled downward by the second wall surface 10*b*, and the pressure change at the time of pressure reduction can be absorbed still more effectively.

In addition, since the first wall surface 10*a* is the horizontal surface, the body 4 on the mouth 2 side rides easily on the body 4 on the bottom 5 side in a more stable state. Accordingly, irregular deformation, such as bending of the neck, can be suppressed more effectively.

In addition, the technical scope of the invention is not limited to the above embodiment, but various modifications may be made without departing from the scope of the invention.

For example, in the above embodiment, the bottle 1 is integrally formed by the biaxially-drawn blow molding from synthetic resins, such as PET, the manufacturing method is not limited thereto. Additionally, although description has been made taking the bottle 1 in which the body 4 has a circular cross-sectional shape as an example, the body 4 may be an angled bottle formed in an angled shape.

Additionally, in the above embodiment, the first wall surface 10*a* is a horizontal surface orthogonal to the bottle axis L. However, a flat surface which inclines to the bottle axis L may be adopted. Moreover, the first wall surface may be a wall surface formed in the shape of a curved surface similarly to the second wall surface 10*b*. It is noted herein that the horizontal surface is preferably adopted as the first wall surface.

Additionally, the first wall surface 10*a* and second wall surface 10*b* may be connected together via a connecting wall. In this case, the cross-sectional shape of the annular groove 10 becomes a substantially trapezoidal shape, and the connecting wall can be appropriately set to a planar shape (which is parallel to or inclined with respect to the bottle axis L) or the shape of a curved surface according to the degree of deformation intended.

Hereinafter, a second embodiment of the bottle according to the present invention will be described with reference to FIGS. 4 to 8. In addition, in the present embodiment, description will be made taking a round bottle formed with a circular cross-section as an example. In addition, the same elements as those of the above embodiment will be designated by the same reference numerals, and a description thereof will be omitted.

Figure 4:
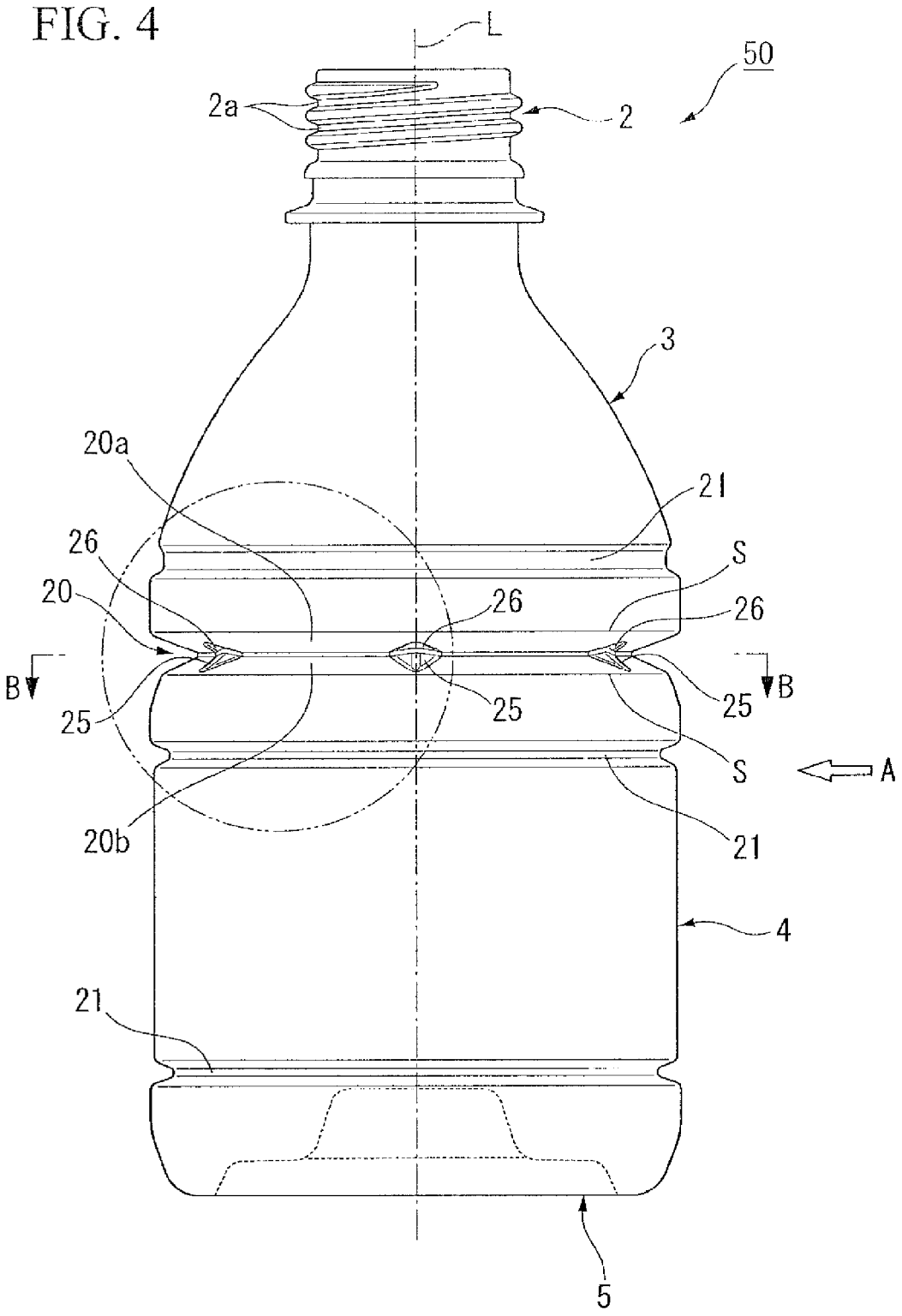
FIG. 4 is a front view showing a second embodiment of the bottle according to the present invention.
Figure 5:
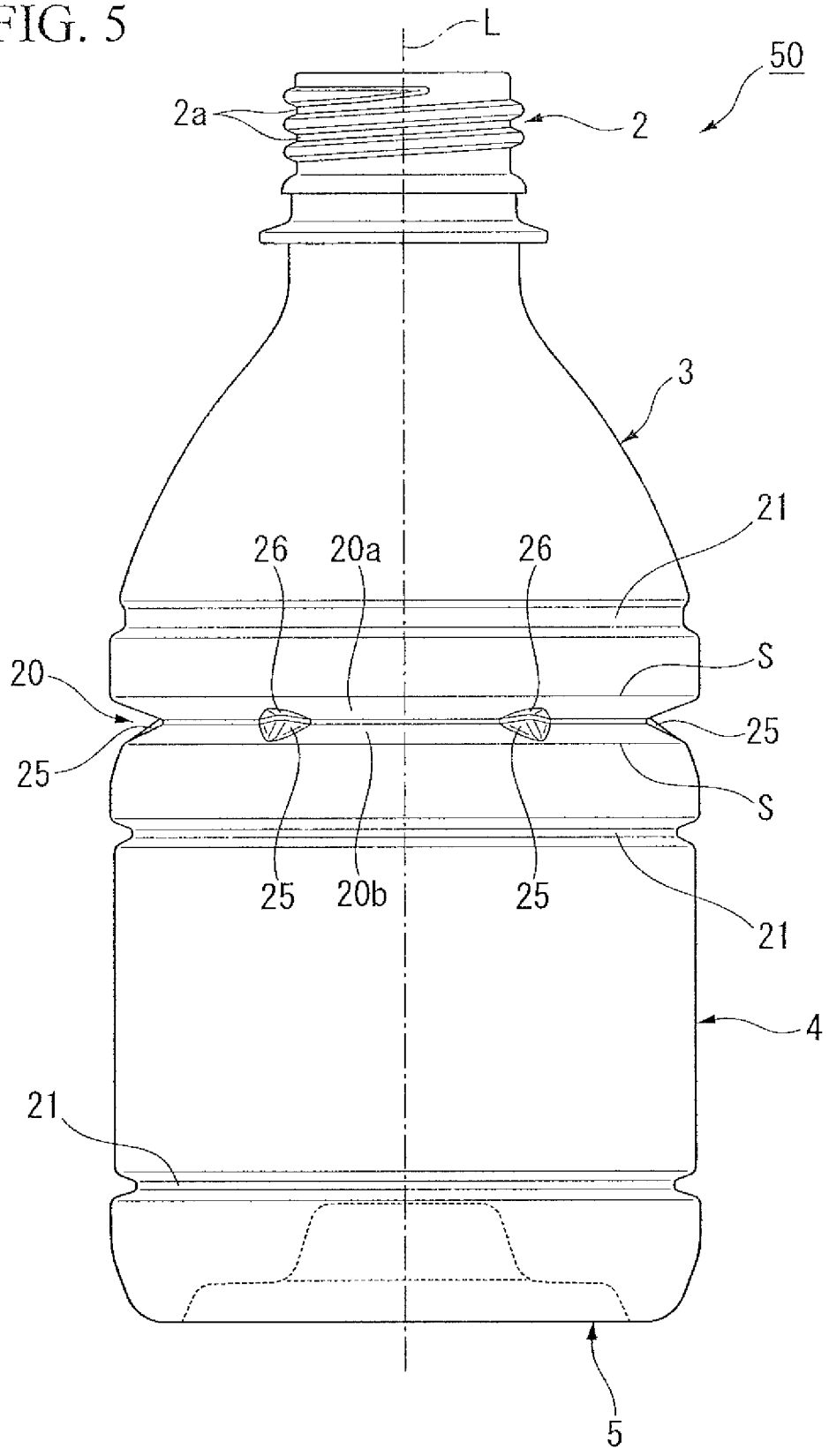
FIG. 5 is a side view when the bottle shown in FIG. 4 is seen from the direction of an arrow A.
Figure 6:
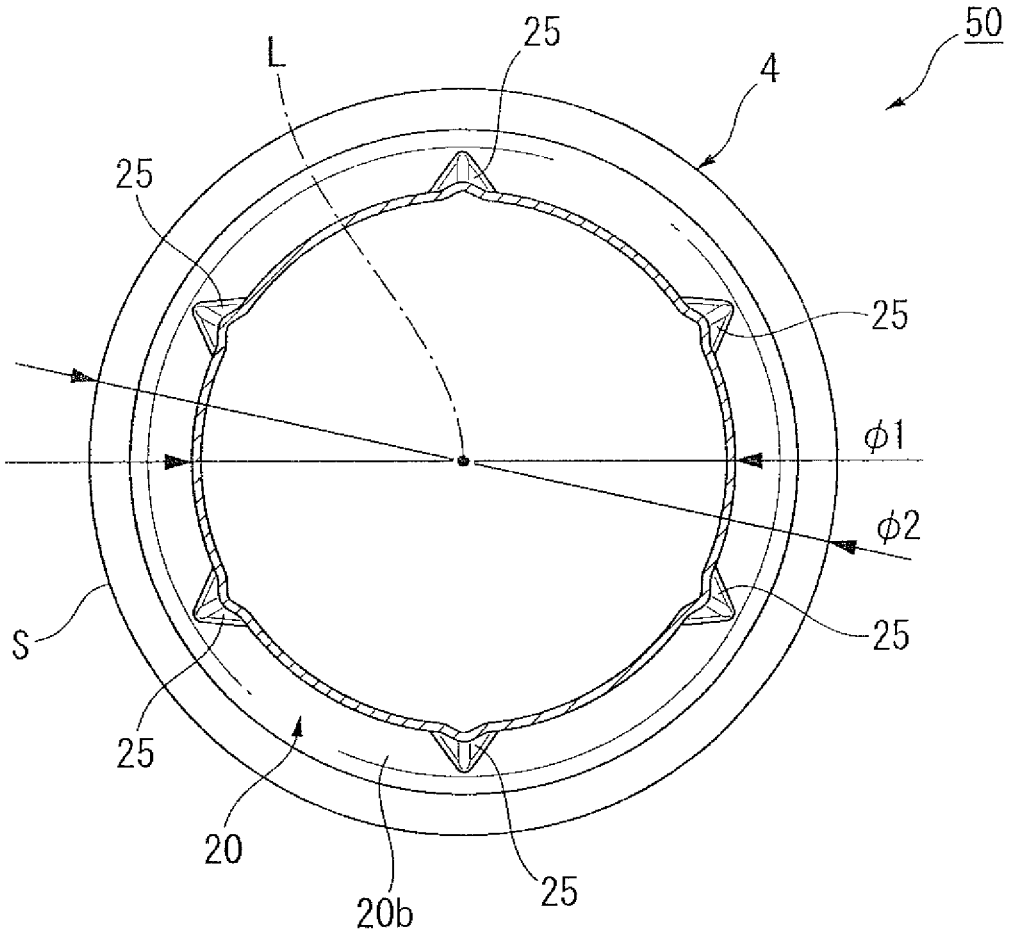
FIG. 6 is a cross-sectional view as seen from the direction of an arrow B-B shown in FIG. 4.

In the present embodiment, as shown in FIGS. 4 to 6, the body 4 is formed with a circular cross-section with the bottle axis L as a center. The body 4 is formed with an annular groove 20 for contracting and deforming the body 4 along the axial direction of the bottle axis L when the internal pressure is reduced, and an annular reinforcing rib 21 for reinforcement.

The annular groove 20 is a V-shaped groove which is formed so as to be circumferentially and radially recessed inward along the outer peripheral surface of the body 4 with the bottle axis L as a center on the upper side of the body 4 near the mouth 2. Specifically, the annular groove 20 of the present embodiment is constituted by an upper inclined surface (mouth-side inclined surface) 20*a* and a lower inclined surfaces (bottom-side inclined surface) 20*b* which are two wall surfaces which face each other. Both the inclined surfaces 20*a* and 20*b* are wall surfaces which face each other so as to incline in directions opposite to each other with respect to the bottle axis L. That is, the upper inclined surface 20*a* is an inclined surface which faces the bottom 5 side and the lower inclined surface 20*b* is an inclined surface which faces the mouth 2 side.

Figure 7:
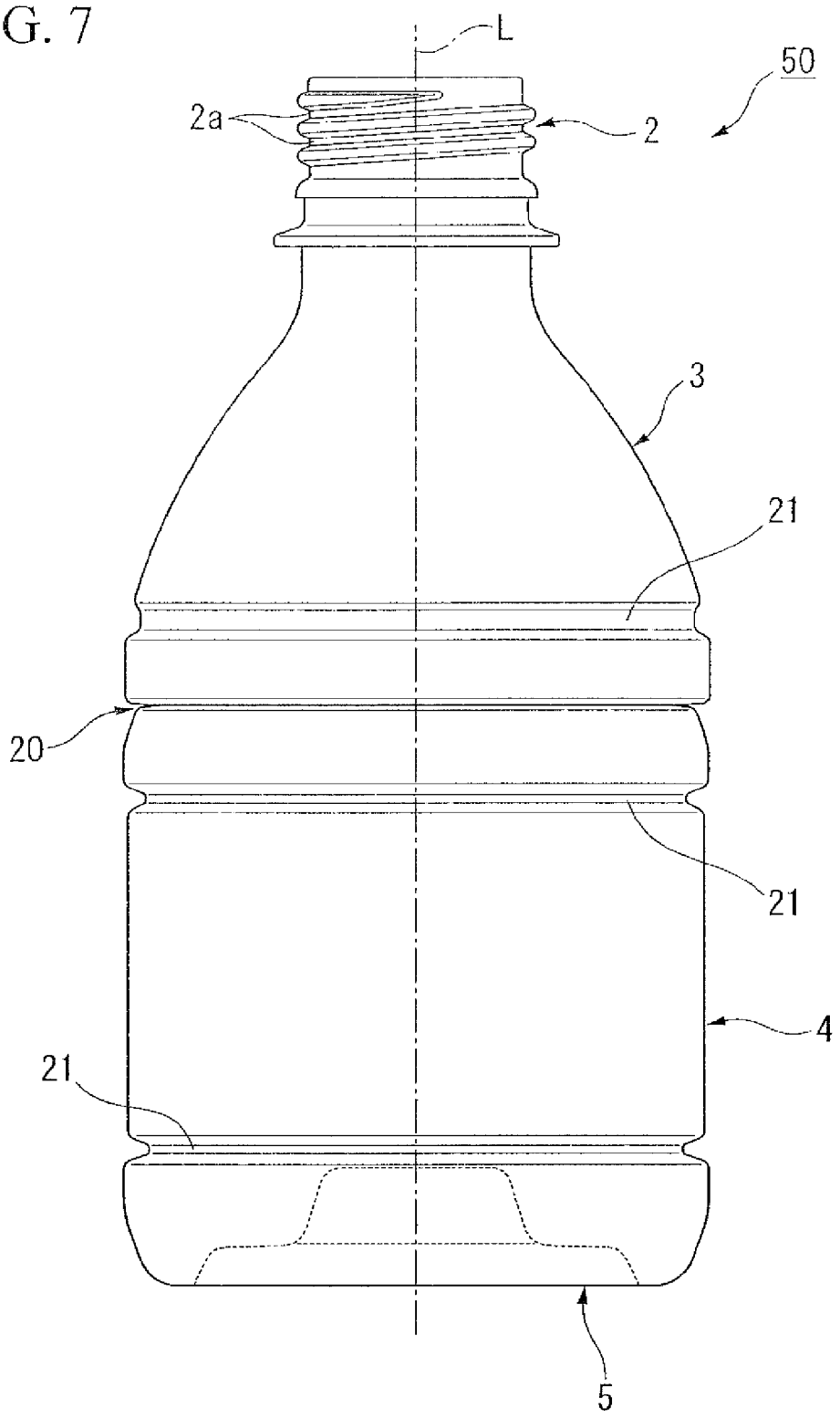
FIG. 7 is a view showing a state where a body has been contracted and deformed in the axial direction of a bottle axis to such a degree that an annular groove is crushed, from the state shown in FIG. 4.

Since the annular groove 20 is circumferentially recessed and formed in the body 4, the body 4 is adapted to be capable of being contracted and deformed in the axial direction of the bottle axis L with the annular groove 20 as a center when the internal pressure is reduced. In this case, as shown in FIG. 7, the body is adapted to be capable of being contracted and deformed to such a degree that the upper inclined surface 20*a* and the lower inclined surface 20*b* approach a position almost near abutment.

In addition, as shown in FIG. 6, the depth of the annular groove 20 is adjusted so that the outer diameter $\phi 1$ has a size of about 80% with respect to the outer diameter $\phi 2$ of the body 4. Since appropriate depth adjustment is made in this way, it is designed so that the body 4 is smoothly contracted and deformed with the annular groove 20 as a center as described above.

In the present embodiment, as shown in FIGS. 4 and 5, three annular reinforcing ribs 21 are formed. One reinforcing rib is formed on the lower side of the body 4 near the bottom 5, and the two remaining reinforcing ribs are formed so as to interpose the annular groove 20 therebetween. The annular reinforcing ribs 21 are all grooves which are circumferentially and radially recessed inward and formed along the outer peripheral surface of the body 4, and play a supplementary role of preventing the body 4 from being irregularly deformed (for example, deformation in an elliptical cross-sectional shape or a triangular cross-sectional shape) in the radial direction at the time of pressure reduction. Additionally, the annular reinforcing ribs also play a role of preventing the body 4 from being irregularly deformed by a gripping force when the body 4 is gripped.

In addition, the annular reinforcing ribs 21 are recessed and formed so as to be shallower than the above-described annular groove 20. Therefore, the body 4 is designed so as not to be contracted and deformed in the axial direction of the bottle axis L substantially with the annular reinforcing rib 21 as a center.

Meanwhile, as shown in FIGS. 4 to 6 and 8, a plurality of protrusions 25 is formed on the lower inclined surface 20*b* which is one inclined surface of the upper inclined surface 20*a* and the lower inclined surface 20*b* which constitute the annular groove 20. Specifically, six protrusions are formed at regular intervals (at every 60 degrees with the bottle axis L as a center) in the circumferential direction. Moreover, the respective protrusions 25 are formed so as to enter closer to the annular groove 20 side than a boundary line (connecting corner) S between the lower inclined surface 20*b* and the outer peripheral surface of the body 4, and are brought into the state of being completely stored in the lower inclined surface 20*b*.

Figure 8:
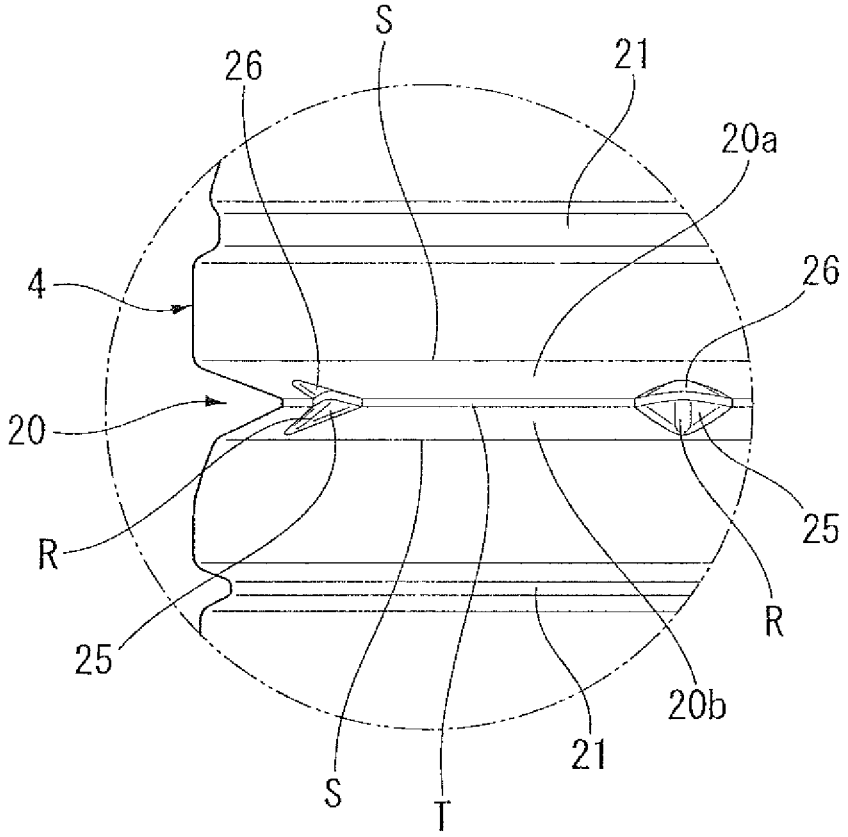
FIG. 8 is a partial enlarged view of the bottle shown in FIG. 4.

Here, the protrusions 25 of the present embodiment will be described in more detail with reference to FIG. 8. The protrusions 25 are formed in the shape of a triangle which has a ridgeline R when the lower inclined surface 20*b* is seen in plane view. In this case, the ridgeline R is designed so as to extend toward the outer peripheral surface of the body 4 while being orthogonal to the circumferential direction of the lower inclined surface 20*b* when the lower inclined surface 20*b* is seen in plane view. That is, the ridgeline R is designed so as to extend radially outward when the body 4 is seen from the axial direction of the bottle axis L. Also, the protrusions 25 are formed in the shape of a triangle of which one side overlaps a valley line T of the annular groove 20 and which protrudes while narrowing gradually toward the above-described boundary line S along the ridgeline R.

On the other hand, recesses 26 which accommodate the protrusions 25, respectively, when both the inclined surfaces 20*a* and 20*b* approach each other are formed at positions which face the protrusions 25, on the upper inclined surface (other inclined surface) 20*a* which is an inclined surface on the side opposite to the lower inclined surface 20*b* on which the protrusions 25 are formed. That is, the recesses 26 are formed at the same regular intervals (every 60 degrees) as the protrusions 25 in the circumferential direction in the upper inclined surface 20*a*. Additionally, the respective recesses 26, similarly to the protrusions 25, are also formed so as to enter closer to the annular groove 20 side than a boundary line S between the upper inclined surface 20*a* and the outer peripheral surface of the body 4, and are brought into the state of being completely stored in the upper inclined surface 20*a*.

Next, a case where the internal pressure of the bottle 50 constructed in this way has been reduced for the reasons of cooling or the like after heating and filling of contents will be described below.

In a case where the internal pressure is reduced, the pressure which will contract the bottle in the axial direction of the bottle axis L and the pressure which will contract the bottle in the radial direction act on the whole bottle 50. In this case, since the annular groove 20 is circumferentially recessed and formed in the body 4, the body 4 is contracted and deformed in the axial direction with the annular groove 20 as a center. Thereby, the aforementioned pressure change at the time of pressure reduction can be absorbed. Moreover, since the annular groove 20 is formed in the shape of the letter V by the upper inclined surface 20*a* and the lower inclined surface 20*b*, the body 4 is easily contracted and deformed in the axial direction with the annular groove 20 interposed therebetween. Hence, the above pressure change can be immediately absorbed with an immediate reaction.

On the other hand, since the bottle 50 simultaneously receives the pressure which will contract the bottle in the radial direction independently from the pressure which will contract the bottle in the axial direction, the force pulling radially inward also acts on the portion of the annular groove 20. However, since the protrusions 25 are formed on the lower inclined surface 20*b* which constitutes the annular groove 20, it is considered that the body 4 can suppress such deformation in which folded wrinkles are created due to the elastic deformation with the protrusions 25 as base points. Particularly, since the protrusions 25 have the ridgeline R, the protrusions are easily deformed with the ridgeline R as a base point. Accordingly, it is considered that the above-described elastic deformation is easily induced in the body 4.

From the foregoing, an internal pressure change caused at the time of pressure reduction can be reliably absorbed in the axial contraction of the bottle axis L while suppressing such plastic deformation in which folded wrinkles may be created in the annular groove 20.

Moreover, since the bottle 50 of the present embodiment has three annular reinforcing ribs 21, irregular deformation of the body 4 hardly occur at the time of pressure reduction, the radial rigidity, for example, when the bottle 50 is gripped, is also excellent. Additionally, since the bottle 50 is a bottle of a unpanelled type in which the body 4 is not provided with a general pressure-reduction absorption panel, design thereof can be comparatively freely performed without being restricted by the pressure-reduction absorption panel. Hence, the degree of design freedom can be improved.

Additionally, the bottle 50 of the present embodiment can exhibit the following working effects in addition to the above-described working effects.

First, since a plurality of protrusions 25 is formed, creation of folded wrinkles can be effectively suppressed in all the regions in the circumferential direction. That is, since the elastic deformation with the protrusions 25 as base points occurs equally in the circumferential direction of the body 4, it is considered that the possibility of folded wrinkles being created in the annular groove 20 can be further reduced.

Additionally, since the recesses 26 are formed in the upper inclined surface 20*a* which constitutes the annular groove 20, even if the body 4 is contracted and deformed to such a degree that the annular groove 20 is crushed in the axial direction of the bottle axis L, as shown in FIG. 7, the protrusions 25 can be prevented from interfering with the upper inclined surface 20*a*.

When the internal pressure is reduced, as described above, the body 4 is contracted and deformed in the axial direction with the annular groove 20 as a center, thereby absorbing a pressure change within the bottle 50. However, in a case where this pressure change is comparatively large, the body 4 is contracted and deformed to such a degree that the annular groove 20 is completely crushed (the upper inclined surface 20*a* and the lower inclined surface 20*b* abut on each other). In this case, there is a probability that the protrusions 25 may interfere with the upper inclined surface 20*a*, and thus contraction deformation of the body 4 may be hindered, or folded wrinkles may be created in the upper inclined surface 25*a* by the protrusions 25.

However, since the recesses 26 in which the protrusions 25 are accommodated are formed in the upper inclined surface 20*a*, the probability that the protrusions 25 may interfere with the upper inclined surface 20*a* and hinder contraction deformation of the body 4 can be eliminated.

Moreover, the protrusions 25 are formed in a state where the protrusions are completely stored in the lower inclined surface 20*b*, and are designed so that portions of the protrusion 25 are not exposed to the outer peripheral surface side of the body 4 beyond the boundary line S between the lower inclined surface 20*b* and the outer peripheral surface of the body 4. Accordingly, a probability that the protrusions 25 may abut on the boundary line S, and folded wrinkles may be created in the outer surface of the bottle can be prevented in advance.

In addition, the technical scope of the invention is not limited to the above embodiment, but various modifications may be made without departing from the scope of the invention.

For example, in the above embodiment, the bottle is integrally formed by the biaxially-drawn blow molding from synthetic resins, such as PET, the manufacturing method is not limited thereto. Additionally, although a description has been made taking the bottle in which the body 4 has a circular cross-sectional shape as an example, the body 4 may be an angled bottle formed in an angled shape.

Additionally, although description has been made in the above embodiment taking the case where only one annular groove 20 is formed as an example, two or more annular grooves may be formed. Even in this case, the same working effects can be exhibited. Additionally, although three annular reinforcing ribs 21 are formed, the formation position and number thereof may be designed freely. Appropriate changes may be made to the annular grooves 20 and the annular reinforcing rib 21 according to the size, shape, and the like of a bottle.

Additionally, in the above embodiment, the protrusions 25 are formed on the lower inclined surface 20*b* which constitutes the annular groove 20 and the recesses 26 are formed in the upper inclined surface 20*a*. Contrary to this, however, the protrusions 25 may be formed on the upper inclined surface 20*a* and the recesses 26 may be formed in the lower inclined surface 20*b*. Even in this case, the same working effects can be exhibited. Moreover, the protrusions 25 and the recesses 26 may be formed in both the upper inclined surface 20*a* and the lower inclined surface 20*b*, respectively. For example, the protrusions 25 and the recesses 26 may be formed in both the upper inclined surface 20*a* and the lower inclined surface 20*b* so as to be lined up alternately in the circumferential direction. Even in this case, the same working effects can be exhibited.

Moreover, although the case, where both the two wall surfaces that constitute the annular groove 20 are constructed by inclined surfaces (the upper inclined surface 20*a*, the lower inclined surface 20*b*), is exemplified in the above embodiment, one of the wall surfaces may be constructed as a horizontal surface.

Moreover, although six protrusions 25 and six recesses 26 are formed at regular intervals in the circumferential direction, the number of the protrusions and recesses is not limited to this and may be set freely. Even if not a plurality of protrusions 25 and a plurality of recesses 26, but only one protrusion and only one recess is formed, the same working effects can be expected. It is noted herein that it is preferable that a plurality of (preferably three or more) protrusions 25 be formed and arranged at equal intervals in that a pressure change is absorbed more reliably. Additionally, in a case where a plurality of protrusions 25 is formed, the protrusions may not be arranged at regular intervals. It is noted herein that, since a pressure change can be equally absorbed in a well-balanced manner, it is preferable to arrange the protrusions 25 equally in the circumferential direction at regular intervals.

Hereinafter, a third embodiment of a bottle according to the present invention will be described with reference to FIGS. 9 to 12. In addition, the same elements as those of the above embodiments will be designated by the same reference numerals, and a description thereof will be omitted.

Figure 9:
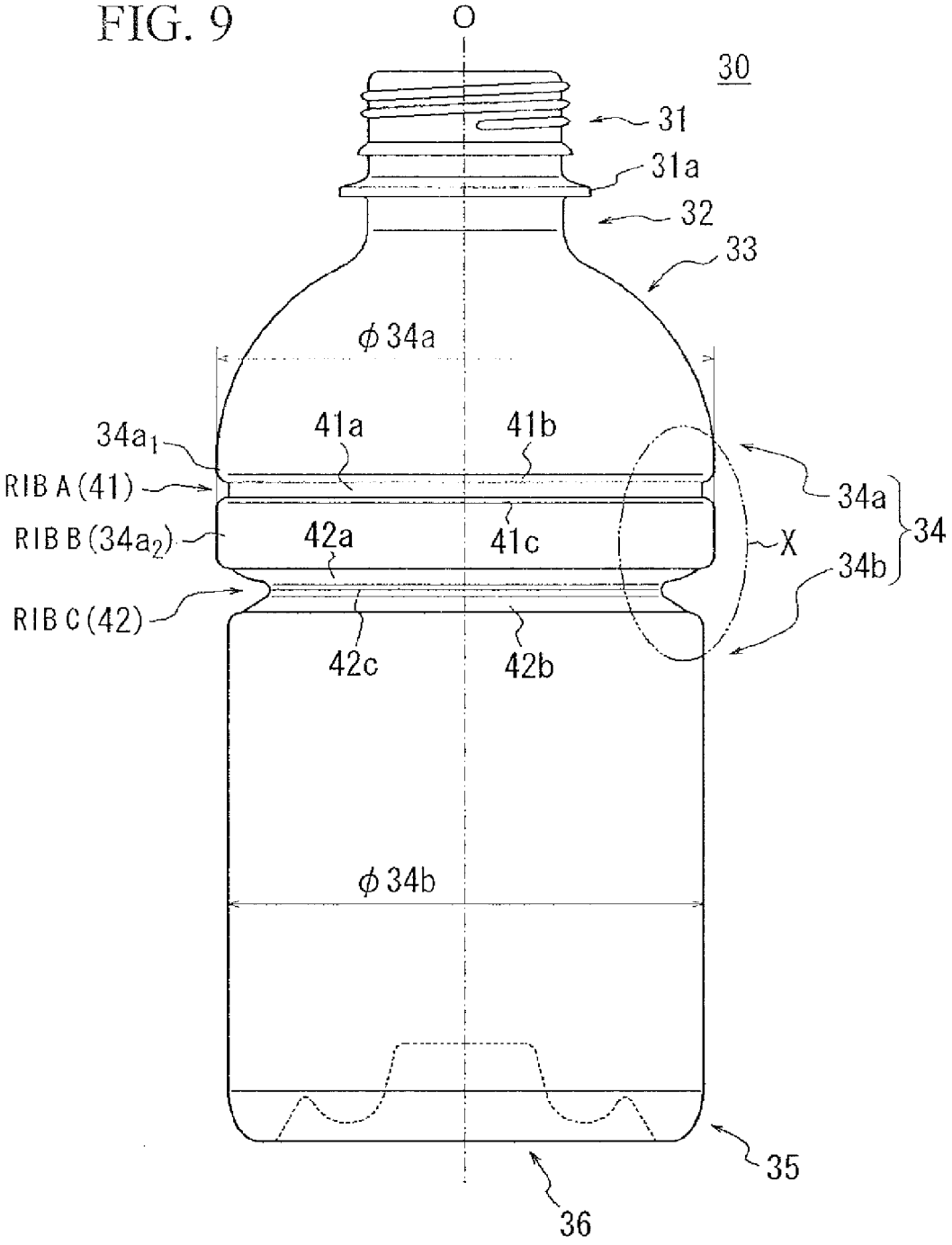
FIG. 9 is a front view showing a state before the filling of the bottle for heat filling according to the present invention.
Figure 10:
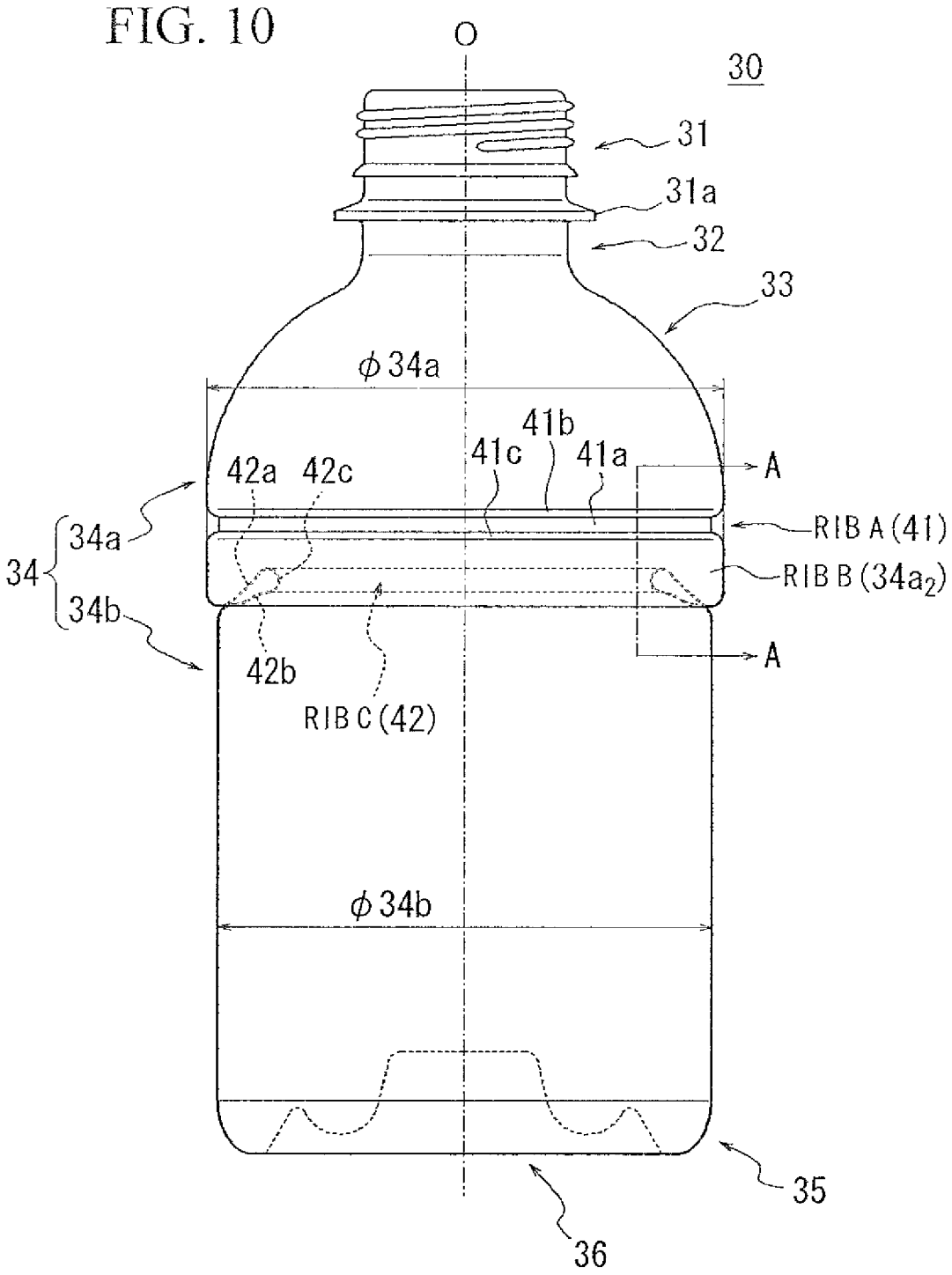
FIG. 10 is a front view showing the pressure-reduced absorbing state of this bottle.
Figure 11:
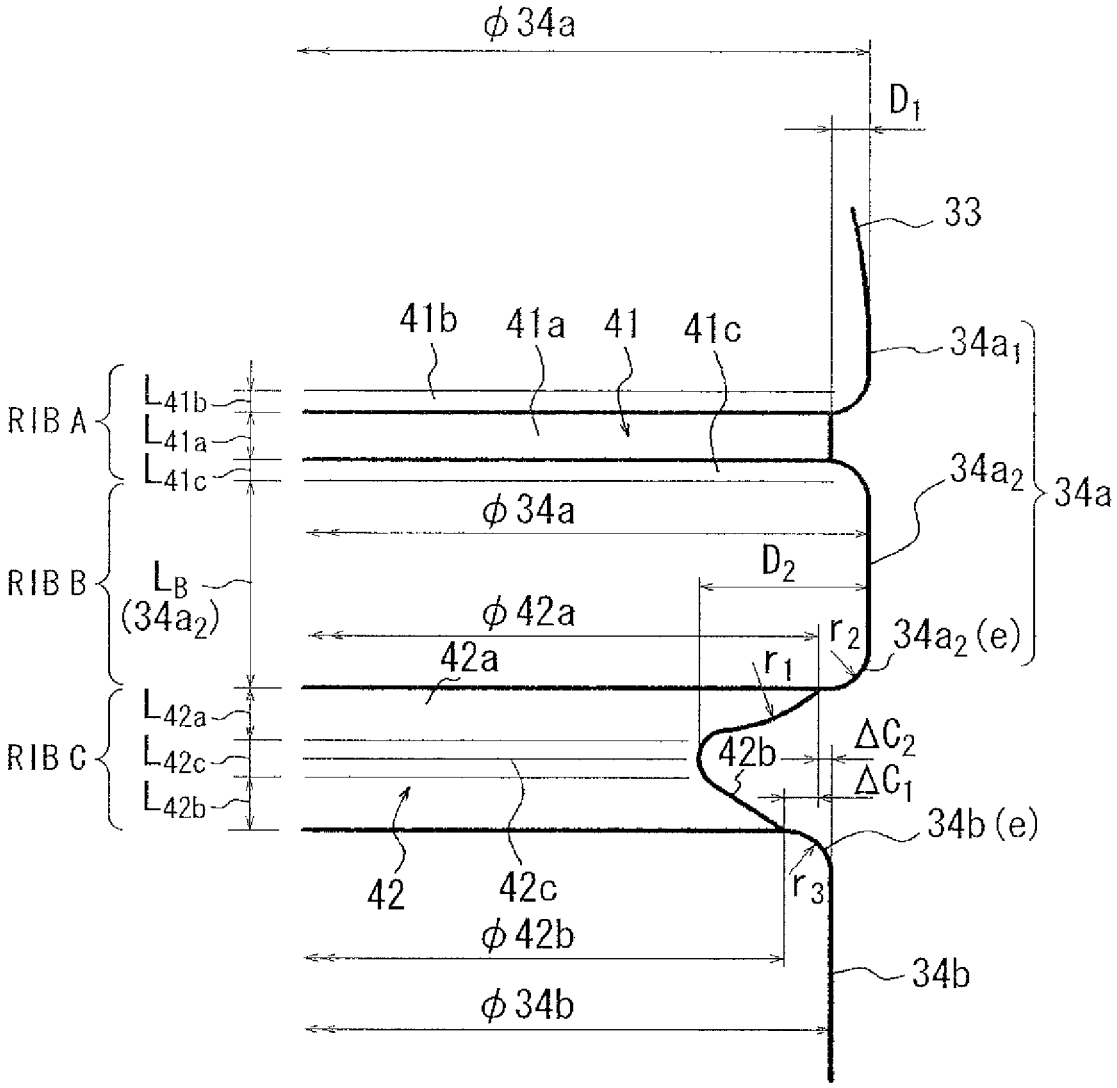
FIG. 11 is an enlarged view of chief portions of a region X shown in FIG. 9.
Figure 12:
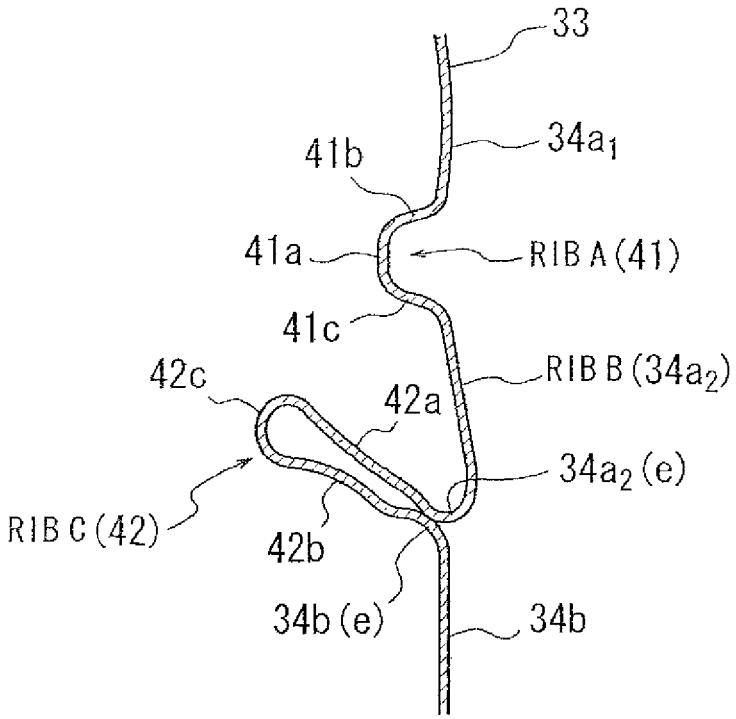
FIG. 12 is a cross-sectional view taken along a line A-A of FIG. 10.

FIGS. 9 and 10 are respectively a front view showing a state before filling of the bottle 30 for heat filling (hereinafter referred to as "bottle") according to the invention and a front view showing the pressure-reduced absorbing state of the bottle 30. Additionally, FIG. 11 is an enlarged view of chief portions of a region X shown in FIG. 9, and FIG. 12 is a cross-sectional view taken along the line A-A of FIG. 10.

The bottle 30 is a biaxially-drawn blow molding bottle obtained by integrally molding a mouth 31, a cylindrical neck tube 32 connected via a neck ring 31*a* provided at the mouth 31, a shoulder 33 which is enlarged in diameter integrally from the neck tube 32, a body 34 connected to the shoulder 33, and a bottom 36 connected to the body 34 via a heel 35 and having polyethylene terephthalate (PET) as a principal component.

The body 34 is formed with a larger diameter portion 34*a* which is formed as a tubular portion of diameter ϕ34*a* by making the diameter of an upper portion 34*a* of the body 34 larger than the diameter of a lower portion 34*b* radially outward, and a smaller diameter portion 34*b* which is formed as a tubular portion of diameter ϕ34*b* which has a smaller diameter than the larger diameter portion 34*a*.

The larger diameter portion 34*a* is formed with a first annular recess (hereinafter referred to as a "first annular recess") 41 which is formed by recessing a portion of the larger diameter portion radially inward along the circumference of an axis O.

As shown in FIG. 11, a maximum inner diameter portion 41*a* of the first annular recess 41 forms an annular flat surface, and the maximum inner diameter portion 41*a* is connected to an upper portion (hereinafter, a "larger diameter upper portion") $\mathbf{34}a_1$ and a lower portion (hereinafter, a "larger diameter lower portion") $\mathbf{34}a_2$ of a larger diameter portion split by the first annular recess 41.

In this case, as shown in FIG. 11, an annular connecting portion 41*b* which connects together the larger diameter upper portion $\mathbf{34}a_1$ and the maximum inner diameter portion 41*a* is formed as an annular curved surface which swells toward the outside of the bottle 30. However, the annular connecting portion 41*b* may be an annular curved surface which swells toward the inside of the bottle 30, an annular flat surface which extends while inclining radially outward toward the larger diameter upper portion $\mathbf{34}a_1$, or an annular flat surface which horizontally extends radially outward toward the larger diameter upper portion $\mathbf{34}a_1$.

Additionally, as shown in FIG. 11, an annular connecting portion 41*c* which connects together the larger diameter lower portion $\mathbf{34}a_2$ and the maximum inner diameter portion 41*a* is formed as an annular curved surface which swells toward the outside of the bottle 30. However, the annular connecting portion 41*c* may be an annular curved surface which swells toward the inside of the bottle 30, an annular flat surface which extends while inclining radially outward toward the larger diameter lower portion $\mathbf{34}a_2$, or an annular flat surface which horizontally extends radially outward toward the larger diameter lower portion $\mathbf{34}a_2$.

Additionally, the first annular recess 41 may be constructed as an annular curved surface which connects together the larger diameter upper portion $\mathbf{34}a_1$ and the larger diameter lower portion $\mathbf{34}a_2$ which are split by the first annular recess 41, and the inflection point thereof may be the maximum inner diameter portion 41*a*. That is, as the first annular recess 41, various cross-sectional shapes can be employed as long as the cross-sectional shapes can exhibit high strength (high rigidity at which deformation hardly occurs) against buckling.

On the other hand, reference numeral 42 designates a second annular recess (hereinafter referred to as a "second annular recess") which is formed by recessing a portion of the smaller diameter portion 34*b* radially inward along the circumference of the axis O so as to come into contact with the larger diameter lower portion $\mathbf{34}a_2$.

The second annular recess 42 has an annular upper surface (hereinafter referred to as a "second annular recess upper surface") 42*a* which is connected to the larger diameter lower portion $\mathbf{34}a_2$, and an annular lower surface (hereinafter referred to as a "second annular recess lower surface") 42*b* which is connected to the smaller diameter portion 34*b*. These annular upper and lower surfaces are connected together by the maximum inner diameter portion 42*c* which is formed as a curved surface. In addition, according to the invention, the maximum inner diameter portion 42*c* may be an annular flat surface as long as the second annular recess upper surface 42*a* can be folded toward the second annular recess lower surface 42*b*.

Additionally, the second annular recess upper surface 42*a* may be adapted such that deformation hardly occurs when being folded toward the second annular recess lower surface 42*b*. In the present embodiment, as shown in FIG. 11, the larger diameter lower portion $\mathbf{34}a_2$ and the maximum inner diameter portion 42*c* are connected together as an annular curved surface which swells toward the outside of the bottle 30 with the radius of curvature $r_1$. In this regard, according to the invention, an annular curved surface which swells toward the inside of the bottle 30, a flat surface which horizontally extends radially outward toward the larger diameter lower portion $\mathbf{34}a_2$ or extends while inclining radially outward, or the like may be adopted as the second annular recess upper surface 42*a*.

Additionally, in combination with this, in the present embodiment, the portion $\mathbf{34}a_2$(e) of the larger diameter lower portion $\mathbf{34}a_2$ which comes into contact with the second annular recess upper surface 42*a* is also constructed as an annular curved surface which swells toward the outside of the bottle 30 with the radius of curvature $r_2$. In this regard, according to the invention, the portion $\mathbf{34}a_2$(e) which comes into contact with the second annular recess upper surface 42*a* may be constructed as an annular curved surface which swells toward the inside of the bottle 30 with the radius of curvature $r_2$, a flat surface which horizontally extends radially outward toward the larger diameter lower portion $\mathbf{34}a_2$ or extends while inclining radially outward, or the like.

The second annular recess lower surface 42*b* may be adapted such that deformation hardly occurs when the second annular recess upper surface 42*a* is folded. In the present embodiment, as shown in FIG. 11, the smaller diameter lower portion 34*b* and the maximum inner diameter portion 42*c* are connected together as an annular flat surface which extends while inclining radially outward toward the smaller diameter portion 34*b*. In this regard, according to the present embodiment, an annular flat surface which horizontally extends radially outward toward the smaller diameter portion 34*b*, or an annular curved surface which swells toward the outside or inside of the bottle 30 can also be adopted as the second annular recess lower surface 42*b*.

Additionally, in combination with this, in the present embodiment, the portion 34*b*(e) of the smaller diameter portion 34*b* which comes into contact with the second annular recess lower surface 42*b* is also constructed as a curved surface which swells toward the outside of the bottle 30.

Moreover, the second annular recess 42 may be formed in the smaller diameter portion 34*b* so as to come into contact with the larger diameter portion 34*a*. In this case, the second annular recess upper surface 42*a* may be connected to the larger diameter portion 34*a* so that the outermost diameter ϕ42*a* thereof becomes equal to the outer diameter ϕ34*b* of the smaller diameter portion 34*b*. However, in the present embodiment, the second annular recess upper surface 42*a* is adapted so that a deviation $\Delta C_1$ is caused radially outward with respect to the second annular recess lower surface 42*b* by making the outermost diameter ϕ42*a* longer than the outermost diameter ϕ42*b* of the second annular recess lower surface 42*b* and a deviation $\Delta C_2$ is caused radially inward with respect to the smaller diameter portion 34*b* by making the outermost diameter ϕ42*a* shorter than the outer diameter ϕ34*b* of the smaller diameter portion 34*b*.

That is, as cross-sectional shapes of the second annular recess 42, various cross-sectional shapes (in which deformation hardly occurs) can be adopted as long as the second annular recess upper surface 42*a* which is connected to the larger diameter lower portion 34*a*$_2$ is easily folded toward the second annular recess lower surface 42*b* which is connected to the smaller diameter portion 34*b*.

In addition, in the present embodiment, the maximum depth $D_2$ of the second annular recess 42 from the larger diameter portion 34*a* is set to be larger than the maximum depth $D_1$ of the first annular portion 41 from the larger diameter portion 34*a* ($D_2>D_1$). Additionally, the maximum depth $D_2$ is made equal to or smaller than the axial dimension $L_B$ between the first annular recess 41 and the second annular recess 42 ($D_2 \leq L_B$). Thereby, the second annular recess upper surface 42*a* is more easily folded toward the second annular recess lower surface 42*b*.

In the present invention, the upper portion and the lower portion of the body 34 are formed as the larger diameter portion 34*a* and the smaller diameter portion 34*b*, respectively, the first annular recess 41 is formed by recessing a portion of the larger diameter portion 34*a* radially inward along the circumference of the axis O, the second annular recess 42 is formed by recessing a portion of the smaller diameter portion 34*b* radially inward along the circumference of the axis O so as to come into contact with the larger diameter portion 34*a*. Furthermore, the second annular recess upper surface 42*a* is made foldable toward the second annular recess lower surface 42*b* by making the maximum depth $D_2$ of the second annular recess 42 from the larger diameter portion 34*a* larger than the maximum depth $D_1$ of the first annular recess 41 from the larger diameter portion 34*a* and equal to or smaller than the axial dimension $L_B$ between the first annular recess 41 and the second annular recess 42. Therefore, the second annular recess upper surface 42*a* is easily folded toward the second annular recess lower surface 42*b* over its entire circumference. For this reason, as the internal pressure of the bottle 30 is reduced or an external force is applied to the bottle 30 in the direction of the axis O, the bottle 30 can be easily compressed and deformed with respect to the direction of the axis O.

Moreover, according to the embodiment of the present invention, even after the second annular recess upper surface 42*a* is folded toward the second annular recess lower surface 42*b*, the folded state can be maintained. Since the folded state is not related to whether or not the bottle 30 is in a pressure-reduced state, contents can also be filled in a state where the bottle 30 is folded and compressed in advance.

Accordingly, in the bottle 30 according to the embodiment of the present invention, the body 34 is equally folded in the direction of the axis O and the folded state is maintained even if the internal pressure of the bottle 30 is reduced. Therefore, it is possible to provide a bottle which has an aesthetic outward appearance and is beautiful to markets or the like.

In addition, it is considered that the reason why the folding in the second annular recess 42 becomes easy is because the rigidity in the first annular recess 41 formed above the second annular recess 42 is high and the first annular recess 41 functions as a rib A which is bendable without buckling, and thereby, the larger diameter lower portion 34*a*$_2$ spreads radially outward as a rib B which is not deformable, and the second annular recess 42 functions as a rib C which easily bends radially inward. On the other hand, it is considered that the reason why the folded state in the second annular recess 42 is maintained is because the first annular recess 41 serving as the rib A with high rigidity prevents its restoration if the larger diameter lower portion 34*a*$_2$ serving as the rib B spreads radially outward and the second annular recess 42 serving as the rib C is once bent.

For this reason, in the present embodiment of the present invention, if the maximum depth D1 of the first annular recess 41 from the larger diameter portion 34*a* is set to be equal to or smaller than half ($D_1 \leq D_2/2$) of the maximum depth $D_2$ of the second annular recess 42 from the larger diameter portion 34*a*, the rigidity of the first annular recess 41 is increased effectively. Thus, the folding in the second annular recess 42 becomes still easier, and the folded state can be maintained more firmly.

In addition, in the present embodiment, the axial dimension of the first annular recess 41 is set to be shorter than the axial dimension of the second annular recess 42. Additionally, the respective axial dimensions $L_{41a}$, $L_{41b}$, and $L_{41c}$ of the maximum inner diameter portion 41*a* and connecting portions 41*b* and 41*c* of the first annular recess 41 have the relationship of 2:1:1, and the respective axial dimensions $L_{42a}$, $L_{42b}$, and $L_{42c}$ of the upper surface 42*a*, lower surface 42*b*, and maximum inner diameter portion 42*c* of the second annular recess 42 have the relationship of 1:1:1. Moreover, the radii of curvature $r_1$, $r_2$, and $r_3$ have the relationship of $r_1>r_3=r_2$.

Although preferred embodiments of the invention have been described above, various changes can be made in the claims. For example, although the bottle 30 is a cylindrical bottle, a prismatic bottle or the like can also be adopted. Additionally, although the invention is mainly adopted as one having a heat-filled bottle as a main body, the invention is not limited thereto.

INDUSTRIAL APPLICABILITY

According to the bottle related to the embodiment of the present invention, a pressure change caused at the time of pressure reduction can be absorbed by axial contraction deformation. In addition to this, since the body on the mouth side is stably supported by the body on the bottom side even in a case where contraction deformation has occurred to such a degree that the annular groove is crushed, irregular deformation, such as bending of the neck, can be suppressed.

Additionally, according to the bottle related to the embodiment of the present invention, the bottle can be contracted and deformed in the axial direction while suppressing creation of folded wrinkles at the time of pressure reduction, and a pressure change caused at the time of pressure reduction can be absorbed reliably.

Additionally, according to the bottle related to the embodiment of the present invention, the body of the bottle is equally folded in the direction of the axis and the folded state is maintained even if the internal pressure of the bottle is reduced. Therefore, it is possible to provide to the market or the like a bottle which has an aesthetic outward appearance and is beautiful.

REFERENCE SIGNS LIST

L: BOTTLE AXIS
ϕ1: OUTER DIAMETER OF BODY ON MOUTH SIDE
ϕ2: OUTER DIAMETER OF BODY ON BOTTOM SIDE
1: BOTTLE
2: MOUTH
3: SHOULDER
4: BODY
5: BOTTOM
10: ANNULAR GROOVE
10*a*: FIRST WALL SURFACE
10*b*: SECOND WALL SURFACE
R: RIDGELINE OF PROTRUSION
20: ANNULAR GROOVE
20*a*: UPPER INCLINED SURFACE (WALL SURFACE) OF ANNULAR GROOVE
20*b*: LOWER INCLINED SURFACE (WALL SURFACE) OF ANNULAR GROOVE
25: PROTRUSION
26: RECESS
30: HEAT-FILLED BOTTLE (BOTTLE)
31: MOUTH
31*a*: NECK RING
32: NECK TUBE
33: SHOULDER
34: BODY
34*a*: BODY UPPER PORTION (LARGER DIAMETER PORTION)
34$a_1$: LARGER DIAMETER UPPER PORTION (UPPER PORTION OF LARGER DIAMETER PORTION)
34$a_2$: LARGER DIAMETER LOWER PORTION (LOWER PORTION OF LARGER DIAMETER PORTION)
34$a_2$(e): PORTION OF LARGER DIAMETER LOWER PORTION WHICH COMES INTO CONTACT WITH SECOND ANNULAR RECESS 2
34*b*: BODY LOWER PORTION (SMALLER DIAMETER PORTION)
34*b*(e): PORTION OF SMALLER DIAMETER PORTION WHICH COMES INTO CONTACT WITH LOWER SURFACE OF SECOND ANNULAR RECESS
35: HEEL
36: BOTTOM
41: FIRST ANNULAR SURFACE
41*a*: MAXIMUM INNER DIAMETER PORTION OF FIRST ANNULAR RECESS
41*b*: ANNULAR CONNECTING PORTION WHICH CONNECTS TOGETHER LARGER DIAMETER UPPER PORTION AND MAXIMUM INNER DIAMETER PORTION
41*c*: ANNULAR CONNECTING PORTION WHICH CONNECTS TOGETHER LARGER DIAMETER LOWER PORTION AND MAXIMUM INNER DIAMETER PORTION
42: SECOND ANNULAR RECESS
42*a*: SECOND ANNULAR RECESS UPPER SURFACE (UPPER SURFACE OF SECOND ANNULAR RECESS CONNECTED TO LARGER DIAMETER LOWER PORTION)
42*b*: SECOND ANNULAR RECESS LOWER SURFACE (LOWER SURFACE OF SECOND ANNULAR RECESS CONNECTED TO SMALLER DIAMETER PORTION)
42*c*: MAXIMUM INNER DIAMETER PORTION OF SECOND ANNULAR RECESS
A: RIB (FIRST ANNULAR RECESS)
B: RIB (LARGER DIAMETER LOWER PORTION)
C: RIB (SECOND ANNULAR RECESS)
D1: MAXIMUM DEPTH OF FIRST ANNULAR PORTION
$D_2$: MAXIMUM DEPTH FROM LARGER DIAMETER PORTION IN SECOND ANNULAR RECESS
$L_B$: AXIAL DIMENSION BETWEEN FIRST ANNULAR RECESS AND SECOND ANNULAR RECESS
$r_1$: RADIUS OF CURVATURE ON SECOND ANNULAR RECESS UPPER SURFACE
$r_2$ RADIUS OF CURVATURE OF THE PORTION OF LARGER DIAMETER LOWER PORTION WHICH COMES INTO CONTACT WITH SECOND ANNULAR RECESS UPPER SURFACE
$r_3$: RADIUS OF CURVATURE OF THE PORTION OF SMALLER DIAMETER PORTION WHICH COMES INTO CONTACT WITH SECOND ANNULAR RECESS LOWER SURFACE

The invention claimed is:

1. A bottomed tubular bottle comprising:

an annular groove which is formed so as to be circumferentially and radially recessed inward along the outer peripheral surface of a body of the bottle with the bottle axis as a center and which contracts and deforms the body in the axial direction of the bottle axis when the internal pressure is reduced, wherein the annular groove has a V-shaped cross section defined by two facing wall surfaces, a protrusion is formed on at least the facing wall surfaces of the annular groove, and when the facing wall surfaces on which the protrusion is formed is seen in plan view, the protrusion is formed in the shape of a triangle, one side of the protrusion overlaps a bottom apex of the V-shaped cross section of the annular groove, and the triangle has a ridgeline which extends toward the outer peripheral surface of the body while being orthogonal to the circumferential direction of the facing wall surfaces.

2. The bottle according to claim 1, wherein the protrusion is one of a plurality of protrusions formed at regular intervals in the circumferential direction.

3. The bottle according to claim 1, wherein the protrusion is positioned closer to the bottom apex of the V-shaped cross section of the annular groove than to an outermost peripheral surface of the body.

4. The bottle according to claim 1, wherein a recess which accommodates the protrusion is formed at a position which faces the protrusion on one of the two facing wall surfaces which faces the protrusion when both of the facing wall surfaces approach each other in the axial direction of the bottle axis.

5. The bottle according to claim 4, wherein the recess is positioned closer to the bottom apex of the V-shaped cross section of the annular groove than to an outermost peripheral surface of the body.

6. A compressively deformable bottle constructed by integrally molding a body and a bottom connected to the body via a heel, the body comprising:

a smaller diameter portion which is a lower cylindrical portion of the body, a larger diameter portion which is an upper cylindrical portion of the body which is made to have a larger diameter than the smaller diameter portion, a first annular recess formed by recessing a portion of the larger diameter portion radially inward along the circumference of the body, and a second annular recess formed by recessing a portion of the smaller diameter portion radially inward along the circumference of the body, the second annular recess being in contact with the larger diameter portion, wherein the maximum depth of the second annular recess, which is from a portion having the maximum outer diameter in the larger diameter portion to the bottom of the second annular recess, is larger than the maximum depth of the first annular recess, which is from a portion having the maximum outer diameter in the larger diameter portion to the bottom of the first annular recess, and equal to or smaller than the axial dimension between the first annular recess and the second annular recess.

7. The bottle according to claim 6, wherein the maximum depth of the first annular recess from the larger diameter portion is set to be half or less of the maximum depth of the second annular recess from the larger diameter portion.

8. The bottle according to claim 6, wherein an upper surface of the second annular recess which is connected to the larger diameter portion is folded toward a lower surface of the second annular recess which is connected to the smaller diameter portion.

* * * * *